US006541171B1

(12) United States Patent
Chowdry et al.

(10) Patent No.: US 6,541,171 B1
(45) Date of Patent: Apr. 1, 2003

(54) SLEEVED PHOTOCONDUCTIVE MEMBER AND METHOD OF MAKING

(75) Inventors: Arun Chowdry, Rochester, NY (US); Steven Cormier, Rochester, NY (US); Dennis Grabb, Sodus, NY (US); Diane M. Herrick, Rochester, NY (US); John W. May, Rochester, NY (US); Edward T. Miskinis, Rochester, NY (US); Michel F. Molaire, Rochester, NY (US); Biao Tan, Rochester, NY (US); Thomas N. Tombs, Brockport, NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/680,133

(22) Filed: Oct. 4, 2000

(51) Int. Cl.[7] ..... G03G 15/02

(52) U.S. Cl. ..... 430/58.65; 399/159; 399/162; 399/164; 399/117

(58) Field of Search ..... 399/159, 162, 399/164, 117; 430/58.65

(56) References Cited

U.S. PATENT DOCUMENTS

| | | | | |
|---|---|---|---|---|
| 1,322,843 | A | 11/1919 | Townsend | |
| 1,457,781 | A | 6/1923 | Loughead | |
| 2,721,601 | A | 10/1955 | Spencer | |
| 2,782,459 | A | 2/1957 | Moncrieff | |
| 2,980,474 | A | 4/1961 | Gargan | |
| 2,988,387 | A | 6/1961 | Eschmann et al. | |
| 3,647,589 | A | 3/1972 | Felden | 156/165 |
| 3,846,901 | A | 11/1974 | Lovett | 29/450 |
| 4,119,032 | A | 10/1978 | Hollis | 101/216 |
| 4,344,700 | A | 8/1982 | Kasama et al. | 355/3 SC |
| 4,381,709 | A | 5/1983 | Katz | 101/375 |
| 4,503,769 | A | 3/1985 | Andersen | 101/153 |
| 4,599,783 | A | 7/1986 | Ceccacci | 29/450 |
| 4,823,160 | A | 4/1989 | Ikuta et al. | 355/3 DR |
| 4,903,597 | A | 2/1990 | Hoage et al. | 101/401.1 |
| 4,913,048 | A | 4/1990 | Tittgemeyer | 101/141 |
| 5,101,726 | A | 4/1992 | Lubke et al. | 101/216 |
| 5,241,905 | A | 9/1993 | Guaraldi et al. | 101/216 |
| 5,298,956 | A | 3/1994 | Mammino et al. | 355/275 |
| 5,415,961 | A | 5/1995 | Yu et al. | 430/58 |
| 5,518,854 | A | 5/1996 | Yu et al. | 430/133 |
| 5,600,423 | A | 2/1997 | Miyashiro et al. | 399/313 |
| 5,890,395 | A | 4/1999 | Kawata et al. | 74/431 |
| 5,895,529 | A | 4/1999 | Foley et al. | 118/423 |
| 5,937,244 | A | 8/1999 | Yoda et al. | 399/159 |
| 5,960,236 | A | 9/1999 | Zaman et al. | 399/91 |
| 6,016,409 | A | 1/2000 | Beard et al. | 399/33 |
| 6,259,873 | B1 * | 7/2001 | Shifley et al. | 399/110 |
| 6,263,177 | B1 * | 7/2001 | Shifley et al. | 399/110 |

FOREIGN PATENT DOCUMENTS

| | | | |
|---|---|---|---|
| EP | 0 246 627 | 11/1987 | G03G/15/00 |
| EP | 0 590 924 A1 | 4/1994 | G03G/15/00 |

OTHER PUBLICATIONS

"A Nonlinear Finite Element Model of Axial Variation in Nip Mechanics With Application to Conical Rollers," by Kenneth D. Stack, Submitted in Partial Fulfillment of the Requirements for the Degree Doctor of Philosophy, Department of Mechanical Engineering, The College School of Engineering and Applied Sciences, University of Rochester, Rochester, NY, 1995.

* cited by examiner

*Primary Examiner*—Mark A. Chapman
(74) *Attorney, Agent, or Firm*—James P. Leimbach

(57) ABSTRACT

A photoconductive sleeved primary image-forming member roller for use in an electrophotographic machine comprising a central member including a rigid cylindrical core member and a compliant layer formed on the core member; and a flexible replaceable removable photoconductive sleeve member in the form of an endless tubular belt that surrounds and non-adhesively intimately contacts the central member.

11 Claims, 8 Drawing Sheets

SLEEVED PHOTOCONDUCTIVE MEMBER AND METHOD OF MAKING

CROSS REFERENCE TO RELATED APPLICATIONS

Reference is made to the commonly assigned U.S. Patent Applications, the disclosures of which are incorporated herein by reference.

U.S. patent application Ser. No. 09/679,113, filed on Oct. 4, 2000, now U.S. Pat. No. 6,393,226, issued on May 21, 2002, in the names of Charlebois et al., entitled: INTERMEDIATE TRANSFER MEMBER HAVING A STIFFENING LAYER AND METHOD OF USING.

U.S. patent application Ser. No. 09/679,177, filed on Oct. 4, 2000, now U.S. Pat. No. 6,393,249, issued on May 21, 2002, in the names of Aslam et al., entitled: SLEEVED ROLLERS FOR USE IN A FUSING STATION EMPLOYING AN INTERNALLY HEATED FUSER ROLLER.

U.S. patent application Ser. No. 09/679,345, filed on Oct. 4, 2000, in the names of Chen et al., entitled: EXTERNALLY HEATED DEFORMABLE FUSER ROLLER.

U.S. patent application Ser. No. 09/680,135, filed on Oct. 4, 2000, now U.S. Pat. No. 6,393,247, issued on May 21, 2002, in the names of Chen et al., entitled: TONER FUSING STATION HAVING AN INTERNALLY HEATED FUSER ROLLER.

U.S. patent application Ser. No. 09/680,139, filed on Oct. 4, 2000, in the names of Charlebois et al., entitled: INTERMEDIATE TRANSFER MEMBER WITH A REPLACEABLE SLEEVE AND METHOD OF USING SAME.

U.S. patent application Ser. No. 09/680,136, filed on Oct. 4, 2000, now U.S. Pat. No. 6,456,816, issued on Sep. 24, 2002, in the names of Chowdry et al., entitled: IMPROVED INTERMEDIATE TRANSFER MEMBER.

U.S. patent application Ser. No. 09/680,138, filed on Oct. 4, 2000, in the names of Chen et al., entitled: AN EXTERNALLY HEATED FUSER ROLLER FOR A TONER FUSING STATION.

U.S. patent application Ser. No. 09/680,134, filed on Oct. 4, 2000, in the names Aslam of et al., entitled: SLEEVED ROLLERS FOR USE IN A FUSING STATION EMPLOYING AN EXTERNALLY HEATED FUSER ROLLER.

U.S. patent application Ser. No. 09/679,016 filed on Oct. 4, 2000, now U.S. Pat. No. 6,377,772, issued on Apr. 23, 2002, in the names of Chowdry et al., entitled: DOUBLE-SLEEVED ELECTROSTATOGRAPHIC ROLLER AND METHOD OF USING.

FIELD OF THE INVENTION

This invention relates to electrophotographic apparatus and, more particularly, to a novel photoconductive member and to a method of making such a member.

BACKGROUND OF THE INVENTION

The use of an intermediate transfer member in an electrostatographic machine to transfer toner from an imaging member to a receiver (e.g., paper) is well known and is practiced in commercial electrophotographic copiers and printers. A toner image formed on a primary image-forming member is transferred in a first transfer operation to an intermediate transfer member, and is subsequently transferred in a second transfer operation from the intermediate transfer member to a receiver. In the second transfer of a toner image from an intermediate transfer member roller to a receiver, a transfer back-up roller is commonly used behind a paper receiver, a nip being formed to press the receiver to the intermediate transfer member.

As disclosed by Rimai et al., in U.S. Pat. No. 5,084,735 and Zaretsky et al., in U.S. Pat. No. 5,370,961, use of a compliant intermediate transfer member roller coated by a thick compliant layer and a relatively thin, hard overcoat improves the quality of electrostatic toner transfer from an imaging member to a receiver, as compared to a non-compliant intermediate roller. Zaretsky, in U.S. Pat. No. 5,187,526, further discloses that electrostatic transfer can be improved by separately specifying the resistivity of the intermediate transfer member roller and the transfer backup roller. Bucks et al., in U.S. Pat. No. 5,701,567, disclose an intermediate transfer member roller having electrodes embedded in a compliant blanket to spatially control the applied transfer electric field. Tombs et al., in U.S. Pat. No. 6,075,965, disclose the use of a compliant intermediate transfer member roller in conjunction with a paper transport belt in a multi-color electrophotographic machine.

For thermal transfer of toner from a photoconductor to a receiver surface, U.S. Pat. No. 5,536,609, by Jackson et al., shows the use of a compliant roller, pad or coating behind a photoconductive belt to assist in the transfer of toner images to a receiving sheet carried by a metal roller. The advantage of the compliant surface behind the photoconductor is that it compresses and widens the nip for good thermal transfer and allows the use of a hard, thermally conductive roller for carrying the receiver paper. Aslam et al., in U.S. Pat. No. 5,339,146, and Miwa et al., in U.S. Pat. No. 4,531,825, also suggest an advantage in a compliant surface for a photoconductive member in transferring toner to a heated, hard intermediate.

The use of a removable endless belt or tubular type of blanket on an intermediate roller has long been practiced in the offset lithographic printing industry, as recently disclosed by Gelinas, in U.S. Pat. No. 5,894,796, wherein the tubular blanket can be made of materials including rubbers and plastics and can be reinforced by an inner layer of aluminum or other metal. As disclosed earlier, for example by Julian in U.S. Pat. No. 4,144,812, an intermediate lithographic roller comprises a portion having a slightly smaller diameter than the main body of the roller, such that a blanket member can be slid along this narrower portion until it reaches a location where a set of holes located in the roller allow a fluid under pressure, e.g., compressed air, to pass through the holes, thereby stretching the blanket member and allowing the entire blanket member to be slid onto the main body of the roller. After the blanket is located in a suitable position, the source of compressed air or fluid under pressure is turned off, thereby allowing the blanket member to relax to a condition of smaller strain, such strain being sufficient to cause the blanket member to snugly embrace the roller. A sleeve for a printing roller and methods for mounting and dismounting are also disclosed in Hoage et al., in U.S. Pat. No. 4,903,597.

Vrotacoe et al., in U.S. Pat. No. 5,553,541, disclose a printing blanket, for use in an offset printing press, which includes a seamless tubular elastic layer having compressible microspheres, surrounded by a seamless tubular layer made of a circumferentially inextensible material, and a seamless tubular printing layer over the inextensible layer. It is disclosed that provision of the inextensible layer reduces or eliminates pre-nip and post-nip bulging of the roller when printing an ink image on a receiver sheet, thereby improving image quality by reducing or eliminating ink smearing caused by slippage associated with the formation of bulges in the prior art.

An intermediate transfer roller consisting of a rigid core and a removable, replaceable intermediate transfer blanket has been disclosed by Landa et al., in U.S. Pat. No. 5,335,054, and by Gazit et al., in U.S. Pat. No. 5,745,829, whereby the intermediate transfer blanket is fixedly and replaceably secured and attached to the core. The intermediate transfer blanket, disclosed for use in conjunction with a liquid developer for toning a primary image, consists of a substantially rectangular sheet mechanically held to the core by grippers. The core (or drum) has recesses where the grippers are located. It will be evident from U.S. Pat. Nos. 5,335,054 and 5,745,829 that owing to the presence of the recesses, the entire surface of the intermediate transfer drum cannot be utilized for transfer, which is a disadvantage requiring costly means to maintain a proper orientation of the useful part of the drum when transferring a toner image from a primary imaging member to the intermediate transfer roller, or, when transferring a toner image from the intermediate transfer roller to a receiver. Moreover, the fact that the blanket does not form a continuous covering of the entire core surface, owing to the fact that two of its' edges are held by grippers, is similarly a disadvantage. Another disadvantage arises because there is inevitably a gap between these edges, so that contamination can become deposited there which can lead to transfer artifacts.

Mammino et al., in U.S. Pat. Nos. 5,298,956, and Mammino et al., in 5,409,557, both disclose a reinforced seamless intermediate transfer member that can be in the shape of a belt, sleeve, tube or roll and including a reinforcing member in an endless configuration having filler material and electrical property regulating material on, around or embedded in the reinforcing member. The reinforcing member can be made of metal, synthetic material or fibrous material, and has a tensile modulus ranging from about 400,000 to more than 1,000,000 psi (2.8 to more than 6.9 GPa). The intermediate transfer member has a thickness between 2 mils and about 7 mils, and a bulk resistivity less than about $10^{12}$ ohm-cm.

A xerographic printing sleeve mountable on a rigid drum, disclosed by Kuehnle in U.S. Pat. No. 4,255,508, includes a very thin inorganic photoconductive crystalline compound such as cadmium sulfide coated on a thin metallic sleeve made of a suitable metal, e.g., nickel. The thickness of the photoconductive layer is 200–600 nanometers and is at most of the order of one micrometer. Such a sleeve is not compliant.

An electrostatographic imaging member in the form of a removable replaceable, endless imaging belt on a rigid roller is disclosed by Yu et al., in U.S. Pat. No. 5,415,961. The electrostatographic imaging member is placed on the rigid roller and removed from the rigid roller by means involving stretching the endless imaging belt with a pressurized fluid.

An electrostatographic imaging member that includes a photoconductive drum that has inserted therein a compressible sleeve, with the composite then being expanded to fit upon a rigid cylindrical core support is disclosed by Swain, in U.S. Pat. No. 5,669,045. The preferred sleeve is a foam that provides substantially no interference fit with the photoconductive drum to facilitate insertion of the sleeve within the drum. However, a relatively large interference fit exists between the rigid core and the sleeve to compress the sleeve as it is expanded by an expandable core. The compression of the sleeve is sufficient to render the electrostatographic imaging member substantially rigid and substantially free from distortion. A problem with an imaging member of the type described by Swain is that the photoconductive drum is not separately removable from the sleeve without also removing the sleeve from the core, thereby subjecting the sleeve to possible damage.

Tombs et al., in U.S. Pat. Nos. 5,715,505, and May et al., in U.S. Pat. No. 5,828,931, both disclose a primary image-forming member roller including a thick compliant blanket layer coated on a core member, the thick compliant blanket surrounded by a relatively thin concentric layer of a photoconductive material. The compliant primary imaging roller provides improved electrostatic transfer of a toner image directly to a receiver member. It is disclosed that the compliant imaging roller can be used bifunctionally, i.e., it can serve also as an intermediate member for electrostatic transfer of a toner image to a receiver. May et al., in U.S. Pat. No. 5,732,311, discloses a compliant electrographic primary image-forming member roller. Disclosures in U.S. Pat. Nos. 5,715,505; 5,828,931; and 5,732,311 are hereby incorporated by reference.

Tombs et al., in U.S. Pat. No. 5,715,505, and May et al., in U.S. Pat. No. 5,828,931, both disclose improvements in the electrostatic transfer of toner images from a photoconductive member to a receiving surface. The photoconductive member has a layer of compliant material having a Young's modulus less than $5\times10^7$ Pascals and a thin, hard photoconductive layer on the layer of compliant material, preferably of thickness less than 15 micrometers and typically having a Young's modulus well in excess of $10^8$ Pascals, for example, $10^{10}$ Pascals or more. The photoconductive members of these patents provide important advantages in the quality of the transferred images. However, the previously known method of making such photoconductive members has certain drawbacks. May et al., in U.S. Pat. No. 5,828,931 discloses, the photoconductive member is made by coating a thin layer of a photoconductive composition on the compliant layer surface of a cylindrical core. A problem encountered in this operation is that the compliant layer materials, which can be, for example, a polyurethane, silicone rubber or other elastomer typically have a low glass transition temperature (Tg). When compliant layer materials are highly cross-linked, they tend to leak residue monomers and to swell in contact with solvents used for coating the photoconductive layer. The compliant layer, therefore, can be damaged by the coating solvent for the photoconductive material. It can also be thermally degraded when the photoconductive layer is heated to evaporate the solvent.

Another drawback of coating a photoconductive layer onto a compliant layer is that the two layers then are adhesively bonded together. Consequently, when the photoconductive layer, after a period of use, becomes worn and needs to be replaced, the entire assembly, including the cylindrical core (which is typically highly toleranced and expensive), the compliant layer and the photoconductive layer must be replaced.

A need exists, therefore, for a novel compliant photoconductive member and for a method of making it that eliminates the need for coating a photoconductive layer on a compliant layer. A need also exists for a photoconductive member in which the photoconductive layer can be replaced when it becomes worn or at the end of its useful life, with continued use of the core and its compliant layer.

SUMMARY OF THE INVENTION

The present invention meets these needs by providing a photoconductive member that is a novel, sleeved, compliant, electrostatographic imaging member, useful in electrostatographic color reproduction, and a method for making such a member. The invention a method of making of said member, and methods for using said member for color reproduction.

The imaging member of the invention, preferably photoconductive, includes a central member including a substantially rigid cylindrical first substrate or core member, a central member having a compliant layer covering and adhered to said first substrate, and a second substrate in the form of a flexible, thin, endless tubular belt having coated thereon an imaging structure including one or more thin layers. Said second substrate and imaging structure form a sleeve in close-fitting but non-adhesive contact with said compliant layer.

In the method of making of a photoconductive imaging member of the invention a compliant backing is made by coating a compliant layer on a first substrate, coating a photoconductive structure including one or more layers on a second substrate, and mounting the coated second substrate in close fitting but non-adhesive contact with the compliant layer of the first substrate.

Methods of using a photoconductive imaging member of the invention include usage as a primary image-forming member and usage as a bifunctional photoconductive intermediate transfer member in color reproduction apparatus.

Advantages obtained by the invention include: preventing the coating solvent used to coat the photoconductive structure from contacting the compliant layer, thereby making a compliant imaging member more reliably and more cheaply, and, providing replacement of the photoconductive structure without the necessity of replacing the compliant layer and its first substrate, thereby lowering cost and reducing downtime.

In accordance with the invention there is provided a photoconductive sleeved primary image-forming member roller for use in an electrophotographic machine comprising a central member including a rigid cylindrical core member and a compliant layer formed on the core member; and a flexible, replaceable, removable, photoconductive sleeve member in the form of an endless tubular belt that surrounds and non-adhesively intimately contacts the central member.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus can be modified. For clarity of understanding of the drawings, relative proportions depicted or indicated of the various elements of which disclosed members are included are not to be representative of the actual proportions, and some of the dimensions can be selectively exaggerated.

FIG. 2(*b*) is a schematic cross-sectional view, not to scale, of a photoconductive member of the invention in pressure contact with a moving web;

FIG. 4(*b*) illustrates a cross-sectional view of a preferred embodiment of a sleeve of a primary image-forming member of the invention including a compliant layer located underneath a photoconductive composite layer structure;

FIG. 5(*b*) is a schematic cross-section, with parts broken away and not to scale, showing a photoconductive sleeve partially mounted on a less preferred structure for a first substrate having a compliant outer layer;

DETAILED DESCRIPTION OF THE PREFERRED EMBODIMENTS

Figure 1:
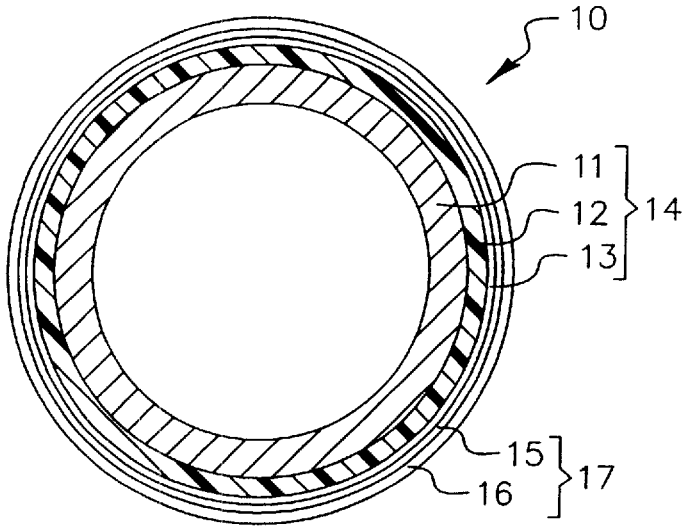
FIG. 1 is a schematic cross sectional view, not to scale, of a cylindrical photoconductive member of the invention.

Because apparatus of the type described herein are well known, the present description will be directed in particular to subject matter forming part of, or cooperating more directly with, the present invention.

The invention relates to a novel compliant sleeved electrostatographic imaging roller which includes a central member having a substantially rigid cylindrical first substrate r core member, a compliant layer covering and adhered to said first substrate, and a second substrate in the form of a thin flexible endless tubular belt having coated thereon an imaging structure including one or more thin layers. Said second substrate and imaging structure form a sleeve in close-fitting but non-adhesive contact with said compliant layer.

A photoconductive roller of the invention utilizing a photoconductive imaging structure on the second substrate can be conventionally charged, image-wise exposed, and toned with particulate thermoplastic toner particles, to form a toner image on the surface of the roller. The toner image is transferable, e.g., electrostatically, to a transferee element, which can have paper, plastic, or any other suitable receiver material. The transferee element can be an intermediate transfer member or it can be a cut receiver sheet or a continuous web.

The invention relates further to electrophotographic full-color imaging utilizing one or more transferable single-color toner images, whereby each single-color toner image can be formed on a compliant sleeved primary image-forming member, transferred in a first transfer step to a transferee element in the form of a compliant intermediate transfer member, and subsequently transferred in a second transfer step to a transferee element in the form of a receiver member, e.g., paper. Additionally, a sleeved roller of the invention can serve bifunctionally both as an image-forming member and as a transferee element in the form of a bifunctional photoconductive intermediate transfer member, so that a transferable first single-color toner image formed on a sleeved primary image-forming member can be transferred in registry on top of a second single-color toner image independently formed on the photoconductive intermediate transfer member, thereby creating a transferable composite two-color image on the intermediate transfer member which can be subsequently transferred to a receiver sheet. A sleeved primary image-forming member can also be used to form a single-color transferable toner image for direct transfer from the sleeved primary image-forming member to a transferee element or to a receiver member. As an alternative to electrophotographic recording, there can be used electrographic recording of each primary color image using stylus recorders or other known recording methods for recording a toner image on a sleeved primary image-forming member which can include a dielectric sleeve member, the transferable toner image to be transferred electrostatically as described herein. Broadly, the primary image is formed using electrostatography, and a sleeved primary image-forming member can include a web or a drum.

Use of a compliant sleeved primary image-forming member in conjunction with an intermediate transfer member has several advantages in that larger nip widths can be attained for a given pressure than if the sleeved primary image-forming member were non-compliant. This in turn allows a lower transfer voltage to be used for transfer of a toner image to an intermediate transfer member, and improves image quality.

In prior art disclosed in Tombs et al., in U.S. Pat. No. 6,075,965, issued on Jun. 13, 2000, single-color toner images formed on conventional photoconductive drums are sequentially transferred in registry to a receiver sheet carried on a moving transport web through a series of corresponding single-color modules. In each module the moving transport web frictionally drives a compliant intermediate transfer member roller, which in turn frictionally drives a counter-rotating primary image-forming member roller. Alternatively, each module can provide transfer of a single-color toner image directly from a primary image-forming member roller to a receiver sheet on the transport web.

Generally speaking, the compliance of a layer can be considered in terms of macrocompliance and microcompliance. In macrocompliance, the layer is able to conform to form a nip. Microcompliance, on the other hand, comes into play at, for example, the scale of individual toner particles, paper roughness, and edges of large toned solid areas. Broadly speaking, a sleeved primary image-forming member of the invention obtains macrocompliance from the compliant layer coated on the core member. In one of the preferred modifications described below, microcompliance functionality can also be obtained by providing a relatively thin compliant layer underneath the imaging structure of the sleeve.

It is well established that for high quality electrostatographic color imaging, small toner particles are necessary. In the color embodiments described herein, it is preferred to use dry, insulative toner particles having a mean volume weighted diameter of between about 2 micrometers and about 9 micrometers. The mean volume weighted diameter measured by conventional diameter measuring devices such as Multisizer™3, sold by Beckman Coulter, Inc. Mean volume weighted diameter is the sum of the mass of each particle times the diameter of a spherical particle of equal mass and density, divided by total particle mass. More preferably, a toner particle diameter of between 6 and 8 micrometers is employed in the present invention. A widely practiced method of improving toner transfer is to use toner particles including sub-micrometer particles of silica, alumina, titania, and the like, attached or adhered to the surfaces of toner particles (so-called surface additives). In practice of the present invention, it is preferred to use a surface additive including sub-micrometer hydrophobic fumed silica particles, but other formulations utilizing sub-micrometer particle surface additives can also be useful.

Figure 7:
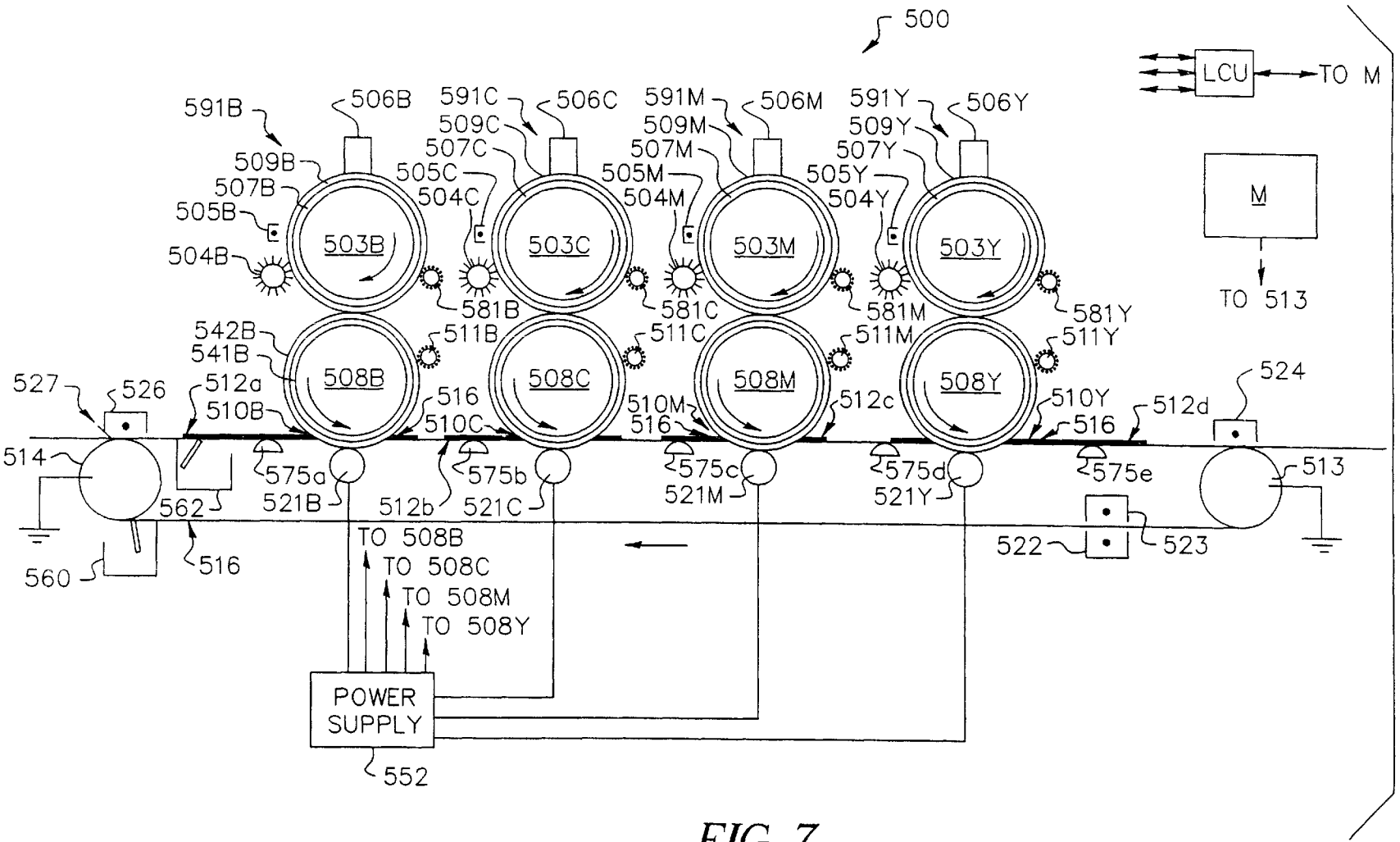
FIG. 7 is a generally schematic side elevational view of an imaging apparatus utilizing four modules, each module including a sleeved photoconductive primary image-forming member from which a single-color toner image is electrostatically transferred to an intermediate transfer roller, with an endless web and web-driving mechanism for facilitating electrostatic transfer of the single-color toner image from the intermediate transfer roller to a receiver member adhered to and carried by the endless web through each of the four modules, only basic components being shown for clarity of illustration.

Referring now to the accompanying drawings, FIG. 7 shows an electrostatographic-imaging apparatus according to a preferred embodiment of the invention. The imaging apparatus, designated generally by the numeral 500, is in the form of an electrophotographic imaging apparatus and more particularly a color imaging apparatus wherein color separation images are formed in each of four color modules and transferred in register from toner image-bearing members to a receiver member as the receiver member is moved through the apparatus while supported on a receiver member transport web 516. A toner image-bearing member can include a sleeved primary image-forming member or an intermediate transfer member, and a toner image can be formed on it or transferred to it from another member. The apparatus features four color modules although this invention is applicable to two or more such modules.

Each module (591B, 591C, 591M, and 591Y) is of similar construction except that as shown one paper transport web 516 which can be in the form of an endless belt operates with all the modules and the receiver member is transported by the receiver member transport web 516 from module to module. The elements in FIG. 7 that are similar from module to module have similar reference numerals with a suffix of B, C, M, and Y referring to the color module to which it is associated; i.e., black, cyan, magenta and yellow, respectively. Four receiver members or sheets 512*a*, 512*b*, 512*c*, 512*d* are shown simultaneously receiving images from the different modules, it being understood as noted above that each receiver member can receive one color image from each module and that in this example up to four color images can be received by each receiver member. The movement of the receiver member with the receiver member transport web 516 is such that each color image transferred to the receiver member at the transfer nip of each module is a transfer that is registered with the previous color transfer so that a four-color image formed on the receiver member has the colors in registered superposed relationship on the receiver member. The receiver members are then serially detacked from the receiver member transport web and sent to a fusing station (not shown) to fuse or fix the dry toner images to the receiver member. The receiver member transport web is reconditioned for reuse by providing charge to both surfaces using, for example, opposed corona chargers 522, 523 which neutralize charge on the two surfaces of the receiver member transport web.

Each color module of FIG. 7 includes a sleeved primary image-forming member, for example a rotating hollow drum labeled 503B, 503C, 503M, and 503Y, respectively. The drums rotate about their respective axes in the directions shown by the arrows. Each sleeved primary image-forming member 503B, 503C, 503M, and 503Y has a compliant central member labeled 507B including a cylindrical core member having a compliant layer formed on its surface (the core and the compliant layer formed on the core are not individually identified in FIG. 7). The central member is snugly and non-adhesively gripped by a removable, replaceable, photoconductive sleeve member in the form of an endless belt, e.g., labeled 509B, upon which a pigmented marking particle image, or a series of different color marking particle images, is formed. A preferred core member is rigid and is generally not solid throughout, but preferably includes a hollow metal tube made for example from aluminum, and can have interior structures which can include chambers, strengthening struts, and the like. The central member preferably has a run-out of less than 80 micrometers, and more preferably less than 20 micrometers. In order to form images, the outer surface of the photoconductive sleeve 509B of the sleeved primary image-forming member is uniformly charged by a primary charging means such as a corona charging device 505B, 505C, 505M, and 505Y, respectively or other suitable charger such as roller chargers, brush chargers, etc. The uniformly charged surface is exposed by suitable exposure means, such as for example a laser 506B, 506C, 506M and 506Y, respectively or more preferably an LED or other electro-optical exposure device or even an optical exposure device to selectively alter the charge on the surface of the sleeved primary image-forming member to create an electrostatic latent image corresponding to an image to be reproduced. The electrostatic latent image is developed by application of pigmented marking particles to the latent-image-bearing photoconductive drum by a development station 581B, 581C, 581M, and 581Y, respectively. The development station is a particular color of pigmented toner marking particles associated respectively therewith. Thus, each module creates a series of different color marking particle images on the respective photoconductive drum. In lieu of a photoconductive drum which is preferred, a photoconductive belt can be used.

Each marking particle image formed on a respective sleeved primary image-forming member or toner-image bearing member toner image-bearing member is transferred electrostatically to an outer surface of a respective secondary or intermediate image transfer member, for example, an intermediate transfer drum 508B, 508C, 508M and 508Y, respectively. After transfer of the toner image the residual toner is cleaned from the surface of the photoconductive drum by a suitable cleaning device 504B, 504C, 504M, and 504Y, respectively to prepare the surface for reuse for forming subsequent toner images. Each intermediate transfer member 508B, 508C, 508M, and 508Y has a core member e.g., labeled 541B which is preferably covered by a compliant layer formed on its surface, e.g. labeled 542B, the compliant layer made from a suitable elastomeric material such as a polyurethane, a silicone rubber, or other elastomers well noted in the literature. Preferably, the compliant layer of the intermediate transfer member has a thickness in a range 2–20 mm, and a Young's modulus preferably less than about 10 MPa, and more preferably in a range of about 1–5 MPa. The silicone rubber, or other elastomers as well noted in the literature. Preferably, the compliant layer of the intermediate transfer member should have a bulk electrical resistivity preferably in a range of about $10^7$–$10^{11}$ ohm-cm, more preferably about $10^9$ ohm-cm. The compliant layer 542B, 542C, 542Y, and 542M is preferably coated on its outer surface by a flexible, thin, hard, release layer (not shown in FIG. 7) which preferably includes a synthetic material such as a sol-gel, a ceramer, a polyurethane or a fluoropolymer, but other materials having good release properties including low surface energy materials can also be used. The release layer has a Young's modulus greater than 100 MPa and a thickness preferably in a range 1–50 micrometers, more preferably 4–15 micrometers. The intermediate transfer member 508B, 508C, 508M, and 508Y can further include one or more sleeves. As disclosed for intermediate transfer embodiments in U.S. patent application Ser. No. 09/680,139, filed on Oct. 4, 2000, in the names of Tombs et al., disclosing a sleeved compliant intermediate transfer member roller can be used including a central member plus a replaceable removable sleeve member. As disclosed for intermediate transfer embodiments in U.S. patent application Ser. No. 09/670,016, filed on Oct. 4, 2000, now U.S. Pat. No. 6,377,772, issued on Apr. 23, 2002, in the names of May et al., disclosing that a double-sleeved compliant intermediate transfer member roller may be used having a core member plus an inner compliant replaceable removable sleeve member and an outer compliant replaceable removable sleeve member. A preferred intermediate transfer member core member 541B is rigid and is generally not solid throughout, but preferably includes a hollow metal tube made for example from aluminum.

Preferably the compliant layer formed on the core member of each central member of photoconductive imaging roller 503B, 503C, 503M, and 503Y, has a thickness in a range of about 0.5–20 mm, and a Young's modulus preferably less than about 10 MPa, and more preferably in a range of about 1–5 MPa. The compliant layer on the core member of the central member has a Poisson's ratio in a range of about 0.2–0.5, and may include a material having one or more phases, e.g., a foam or a dispersion of one solid phase in another. Preferably, the Poisson's ratio of the compliant layer on the core is in a range of about 0.45–0.50.

A thin protective layer may be optionally coated on the outer surface of the compliant layer on the core of central member 507B, 507C, 507M, and 507Y, to aid in removing or replacing the imaging sleeve. This layer is preferably made from any suitable material which is flexible and hard. It is preferred that the protective layer include a coating of a synthetic material, preferably a creamer or a sol-gel, applied to the compliant layer by any suitable coating method. Alternatively, the protective layer may include a thin metal band, e.g., nickel, which may be adhered to the compliant layer on the core or which may be in the form of an endless belt under tension applied to the outer surface of the compliant layer by, for example, using compressed air assist, or by cooling the substrate plus its compliant layer coating in order to shrink it so as to slide on the endless metal belt. The protective layer has a thickness preferably in a range of about 1–50 micrometers and more preferably in a range of about 4–15 micrometers, and has a Young's modulus preferably greater than 100 MPa and more preferably in a range of about 0.5–20 GPa.

Sleeve member 509B located on the sleeved primary image-forming member drum 503B includes a second substrate and a photoconductive structure coated on the second substrate, which may be a backing layer or a stiffening layer. A backing layer is defined as a layer having a Young's modulus of 100 MPa or less, and it can be included of any suitable material, such as for example a polymer, a fabric, a plastic, or any other material suitable as a support or backing for the photoconductive structure. A stiffening layer is a layer having a Young's modulus greater than 100 MPa. The second substrate is preferably conductive, and is preferably a stiffening layer. The photoconductive structure can include one or more layers which can include any known suitable photoconductive material, such as for example, an inorganic material or dispersion, a homogeneous organic photoconductive layer, an aggregated organic photoconductive layer, a composite structure including a charge-generating layer plus a charge-transport layer, and the like. In order to effect electrostatic transfer of a toner image from sleeved primary image-forming member drum 503B to intermediate transfer member drum 508B, it is preferred to connect the preferably conductive second substrate of sleeve 509B to ground potential, in which case the second substrate preferably has a bulk or volume electrical resistivity of less than about $10^{10}$ ohm-cm. However, in some applications it can be desirable to use a non-conductive stiffening layer, in which case the second substrate can be coated with a thin conductive material, e.g., a metallic film applied to the surface of the second substrate, which is connected to ground potential.

Figure 4A:
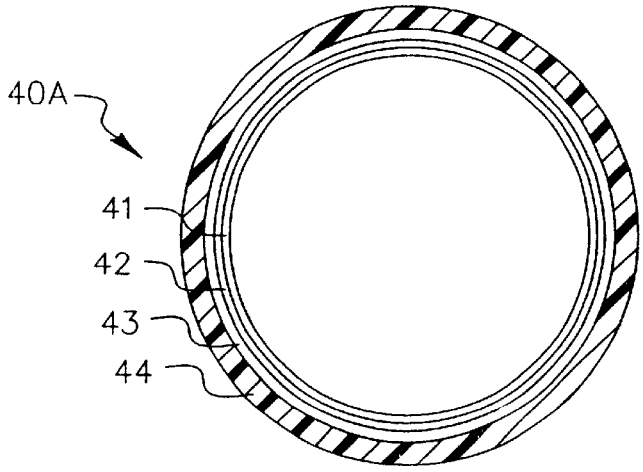
FIG. 4(*a*) illustrates a cross-sectional view of a preferred embodiment of a sleeve of a primary image-forming member of the invention including a photoconductive composite layer structure.
Figure 4B:
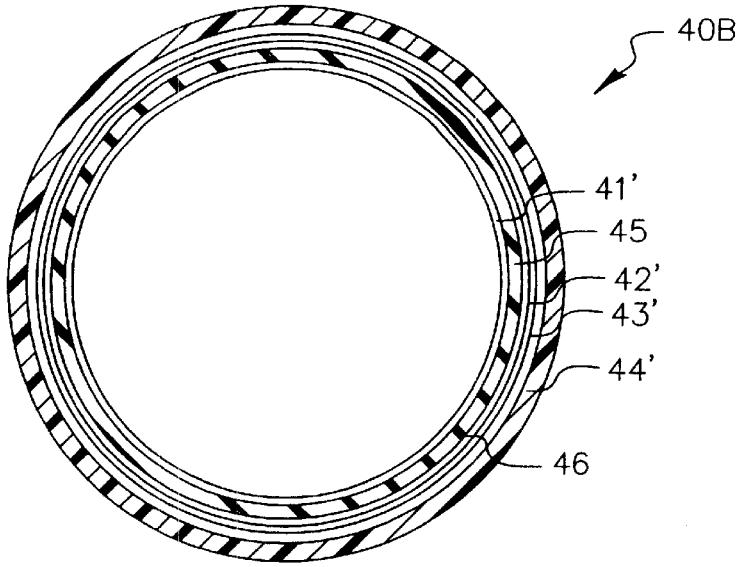

A preferred sleeve member 509B located on the sleeved primary image-forming member drum 503B includes a stiffening layer, a barrier layer coated on the stiffening layer, a charge-generating layer coated on the barrier layer, and a charge-transport layer coated on the charge-generating layer (see for example FIG. 4(*a*)). The stiffening layer preferably has the form of an endless tubular belt. More preferably, the stiffening layer is a seamless belt. The stiffening layer, which preferably has a high modulus and therefore is substantially inextensible, provides a useful function by minimizing hoop strain in the underlying compliant layer 507B. Preferably, the stiffening layer is thin and flexible and includes any suitable conductive material, such as a metal, e.g., steel, nickel, brass or other high tensile metal. Less preferably, the stiffening layer can include an elastomer such as, for example, a polyurethane, doped with a conductive material such as an antistat, or a synthetic polymeric or plastic material including a dispersion of conductive particles having a volume fraction above the percolation threshold, the stiffening layer having a yield strength which is not exceeded during operation of the sleeved primary image-forming member. A stiffening layer of sleeve 509B, 509C, 509M, and 509Y, has a thickness less than about 500 micrometers, preferably in a range of about 10–200 micrometers, and a Young's modulus greater than about 0.1 GPa, preferably in a range of about 50–300 GPa. It is preferred that the stiffening layer is made of nickel in the form of an electroformed seamless belt 0.005 inch thick available, e.g., from Stork Screens America, Inc. of Charlotte, N.C. The preferred photoconductive structure coated on the stiffening layer includes: a polyamide resin barrier layer having thickness greater than about 0.5 micrometer and preferably greater than 1.0 micrometer; a charge-generating layer of the type described by Molaire et al., in U.S. Pat. No. 5,614,342, including a co-crystal dispersion with the charge-generating layer coated on the barrier layer, the charge-generating layer having a thickness in a range 0.5–1.0 micrometer and preferably about 0.5 micrometer; and a charge-transport layer, coated on the charge-genrating layer, having thickness 12–35 micrometers and preferably about 25 micrometers, the charge-transport layer having equal parts of tri-tolylamine and 1,1-bis{4-(di-4-tolylamino)phenyl}methane in a binder consisting of 20% wt/wt poly and 80% wt/wt Makrolon™, polycarbonate obtainable from General Electric Company, Schenectady, N.Y.

In another preferred embodiment, microcompliance can be provided to the sleeve 509B by including a thin compliant layer coated on a stiffening layer underneath the charge-generating layer and the charge-transport layer coatings, the thin compliant layer having a thickness preferably in a range 0.5–2.0 micrometers. A thin conductive layer, e.g., of nickel, can be coated on top of the thin compliant layer, upon which are successively coated an optional barrier layer, a charge-generating layer, and a charge-transport layer, as described above (see for example FIG. 4(*b*)). Preferably the thin conductive layer is grounded during operation. Alternatively, the thin, compliant layer can be coated by an optional, charge injection barrier layer and the compliant layer provided with suitable electrical conductivity so as to be usable with a grounded conductive core member.

In some applications an optional thin hard wear resistant layer can be provided as an exterior coating outside the charge-transport layer, such as for example having a sol-gel, silicon carbide, diamond-like carbon, or the like.

A single-color marking particle image respectively formed on the intermediate transport member roller 508B is transferred to a toner image receiving surface of a receiver member, which is fed into a nip between the intermediate image transfer member drum and a transfer-backing roller 521B, 521C, 521M, and 521Y, respectively, that has an outer resistive blanket and is suitably electrically biased by power supply 552 to induce the charged toner particle image to electrostatically transfer to a receiver sheet. The receiver member is fed from a suitable receiver member supply (not shown) and is suitably "tacked" to the receiver member transport web 516 and moves serially into each of the nips 510B, 510C, 510M, and 510Y, where it receives the respective marking particle image in suitable registered relationship to form a composite multicolor image. As is well known, the colored pigments can overlie one another to form areas of colors different from that of the pigments. The receiver member exits the last nip and is transported by a suitable transport mechanism (not shown) to a fuser where the marking particle image is fixed to the receiver member by application of heat and/or pressure and, preferably both. A detack charger 524 can be provided to deposit a neutralizing charge on the receiver member to facilitate separation of the receiver member from the receiver member transport web 516. The receiver member with the fixed marking particle image is then transported to a remote location for operator retrieval. The respective intermediate transfer members are each cleaned by a respective cleaning device 511B, 511C, 511M, and 511Y, to prepare it for reuse.

Appropriate sensors (not shown) of any well-known type, such as mechanical, electrical, or optical sensors for example, are utilized in the imaging apparatus 500 to provide control signals for the apparatus. Such sensors are located along the receiver member travel path between the receiver member supply through the various nips to the fuser. Further sensors can be associated with the primary image-forming member photoconductive drum, the intermediate image transfer member drum, the transfer-backing member, and various image processing stations. As such, the sensors detect the location of a receiver member in its travel path, and the position of the primary image-forming member photoconductive drum in relation to the image-forming processing stations, and respectively produce appropriate signals indicative thereof. Such signals are fed as input information to a logic control unit including a microprocessor, for example. Based on such signals and a suitable program for the microprocessor, the logic and control unit produces signals to control the timing operation of the various electrographic process stations for carrying out the imaging process and to control drive by motor M of the various drums and belts. The production of a program for a number of commercially available microprocessors, which are suitable for use with the invention, is a conventional skill well understood in the art. The particular details of any such program would, of course, depend on the architecture of the designated microprocessor.

Figure 10:
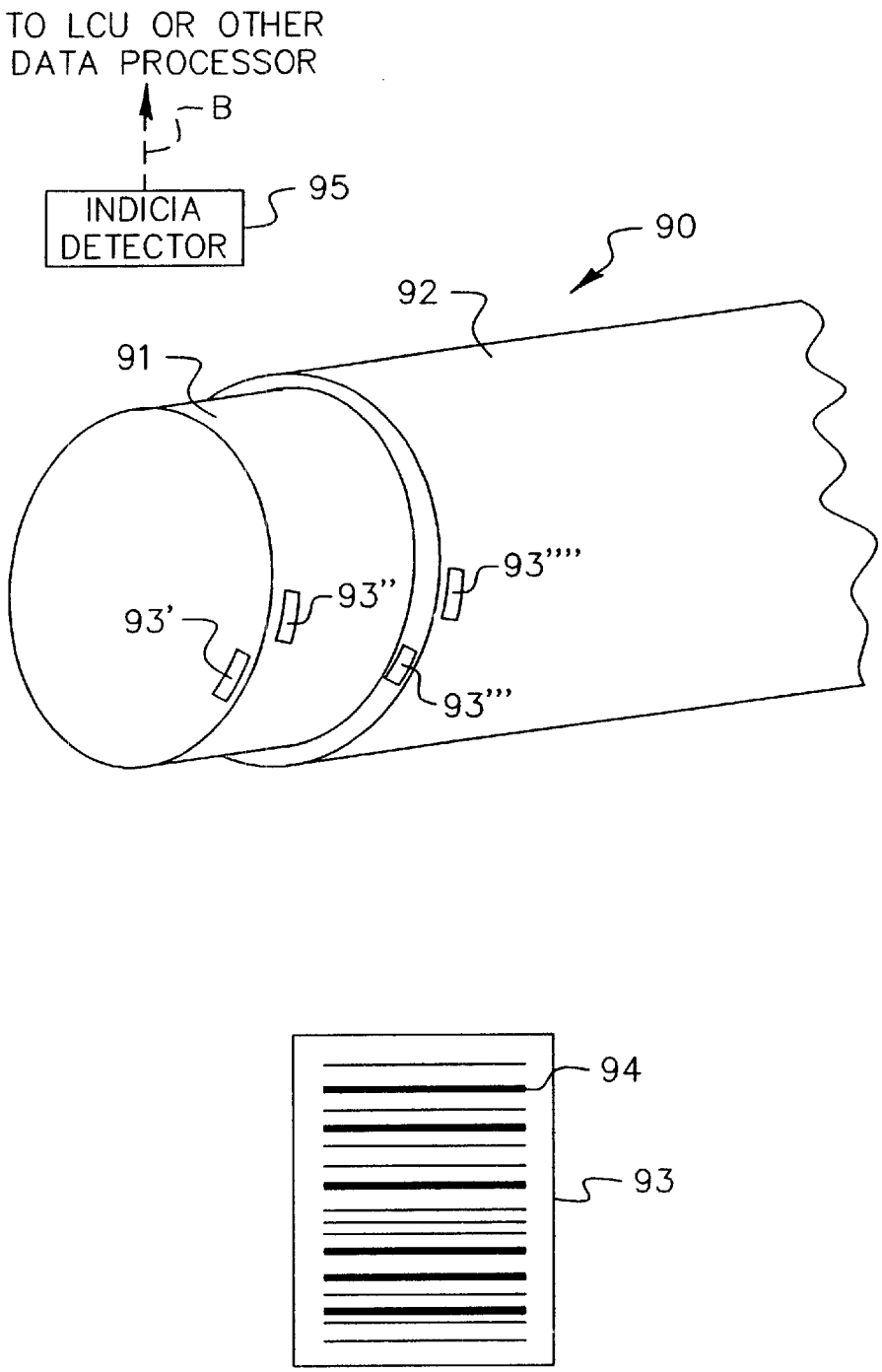
FIG. 10 is a diagrammatic illustration of a partly assembled inventive imaging roller wherein the central member has marked on it a descriptive indicia located on an outer surface of the central member in a small area located close to an end of the central member, and the sleeve imaging member has marked on it descriptive indicia located on the outer surface of the sleeve imaging member in a small area located close to an end of the sleeve imaging member, where for clarity of explanation the sleeve imaging member is shown displaced a short distance with respect to its operational position on the central member in order to reveal a location for an indicia on an outside portion of the central member.

FIG. 10 is a sketch of a cutaway end portion of an assembly, indicated as 90, of a photoconductive sleeve 92 concentrically disposed on a central member 91 of an inventive roller. Central member 91 has marked on it descriptive indicia located on its outer surface in a small area located close to an end of the central member, and the photoconductive sleeve 92 has marked on it descriptive indicia located on its outer surface in a small area located close to an end of the photoconductive sleeve. For clarity of explanation, the photoconductive sleeve is shown displaced from its operational location by a short distance with respect to the central member in order to reveal a location for an indicia on an outside portion of the central member. The indicia are provided on the photoconductive sleeve to indicate a parameter relative to the photoconductive sleeve, and are also provided on the central member to indicate a parameter relative to the central member. With reference to FIG. 10, entities shown therein that are similar to one another are identified with one or more primes (') after the reference numbers. The indicia on the central member, i.e., a set of descriptive markings, can be located in a preferably small area 93" located on a cylindrically curved portion of the central member close to an end of the central member. More preferably, the indicia on the central member are contained in a preferably small area 93' located on an end of central member 91 and close to the perimeter (the individual layers having central member 91 are not shown). The indicia on the photoconductive sleeve member, i.e., a set of descriptive markings, are preferably located in a small area 93" located on a cylindrically curved portion of the photoconductive sleeve member close to an end of the photoconductive sleeve member. More preferably, the indicia on the photoconductive sleeve member are contained in a small area 93" located on an end of sleeve 92 (the individual layers having sleeve 92 are not shown). An enlarged view 93 of any one of the small areas 92', 92", 93", or 92" illustrates that the descriptive indicia can be in the form of a bar code, as indicated by the numeral 94, which can be read, for example, by a scanner. The scanner can be mounted in an electrophotographic machine so as to monitor an inventive roller, e.g., during operation of the machine or during a time when the machine is idle, or the scanner can be externally provided during installation of, or maintenance of, an inventive roller. Generally, the indicia can be read, sensed, or detected by an indicia detector 95. As indicated in FIG. 10 by the dashed arrow labeled B, the analog or digital output of the indicia detector can be sent to a logic and control unit incorporated in an electrostatographic machine utilizing an inventive photoconductive roller, or it can be processed externally, e.g., in a portable computer during the installation or servicing of an inventive photoconductive roller, or it can be processed in any other suitable data processor. The indicia can be read optically, magnetically, or by means of radio frequency. In addition to a bar code 94, the indicia can include any suitable markings, including symbols and ordinary words, and can be color-coded. The indicia can also be read visually or interpreted by eye. A color-coded indicia on a member can include a relatively large colored area which can be otherwise devoid of markings or other features and which can readily be interpreted by eye to indicate a predetermined property of the color-coded member. Suitable materials for the indicia are for example inks, paints, magnetic materials, reflective materials, and the like, which can be applied directly to the surface of the sleeve member. Alternatively, the indicia can be located on a label that is adhered to the outer surface of the sleeve member. The indicia can also be in raised form or produced by stamping with a die or by otherwise deforming a preferably small local area on the outer surface of the sleeve member, and the deformations can be sensed mechanically or otherwise detected or read using an indicia detector 95 in the form of a contacting probe or by other mechanical means. It can also be desirable for some applications to place indicia on the inner surface of sleeve member 92. It can also be desirable to provide a cutaway or an opening in sleeve member 92 so that an indicia located in an area 93" on central member 91 can be detected when the outer sleeve is located in operational position, and not displaced as shown in FIG. 10.

Different types of information can be encoded or recorded in the indicia on the central member and on the photoconductive sleeve. For example, the outside diameter of a roller, i.e., the outside diameter of the photoconductive sleeve member can be recorded so that nip width or registration parameters can be accordingly adjusted. The effective hardness and effective Young's modulus of a sleeve or central member of an inventive roller can be recorded in the indicia so that nip widths can be suitably adjusted. The date of manufacture of the sleeve or central member of the roller can be recorded in the indicia for diagnostic purposes, so that the end of useful life of the given sleeve or central member could be estimated for timely replacement. Specific information for each given roller regarding the roller run-out, e.g., as measured after manufacture, can also be recorded in the indicia, and this information could be used for optimizing registration, e.g., between modules. Moreover, the orientation of an inventive roller, such as for example a skew between an inventive roller and an intermediate transfer roller, can be described by the indicia.

When the outside diameter of the photoconductive sleeve of an inventive roller is recorded in the indicia, the information can be used to speed the calibration time of a registration system as explained below. For example, the registration system can utilize a software algorithm that controls the speed of the start-of-line clock signal fed to an LED write head. A separate start-of-line clock signal is used for each color module, each controlling the length of the color toner image of the respective color separation image produced by each module, thereby ensuring that the color toner image length is correct and uniform throughout the image. It is known that, in general, a change in the engagement between a primary imaging roller and an intermediate transfer member roller changes the speed ratio, thereby altering the length of the image, e.g., by stretching or compressing it as the engagement is increased or decreased. Photoconductive sleeve members cannot be manufactured practically with identical outside diameters, a typical variation being ±50 micrometers. A small difference in the diameter of a newly installed photoconductive sleeve of an inventive roller can, therefore, effectively change the engagement between the primary imaging and intermediate transfer member rollers (for the same applied force between the rollers). Similar changes of engagement can be caused by a manufacturing variability of central members. By utilizing the diameter information of a newly installed photoconductive sleeve, the registration unit can immediately correct the start-of-line clock signal so that the image length and uniformity is maintained correctly. This adjustment of the parameters in the algorithm controlling the start-of-line clock signal is one of several parameters that need to be controlled to ensure accurate registration of each digital image written by the write head. Prior knowledge of the outside diameter of an inventive photoconductive sleeved roller given in the indicia speeds the calibration time of the registration system.

The receiver members utilized with the reproduction apparatus 500 can vary substantially. For example, they can be thin or thick paper stock, or transparency stock, e.g., plastic sheets. As the thickness and/or bulk resistivity of the receiver member stock varies, the resulting change in impedance affects the electric field used in the nips 510B, 510C, 510M, and 510Y, to urge transfer of the marking particles to the receiver members. Moreover, a variation in relative humidity will vary the conductivity of a paper receiver member, which also affects the impedance and hence changes the transfer electric field.

The endless belt or receiver member transport web 516 is preferably included of a material having a bulk electrical resistivity greater than $10^5$ ohm-cm and where electrostatic hold down of the receiver member is not employed, it is more preferred to have a bulk electrical resistivity of between $10^8$ ohm-cm and $10^{11}$ ohm-cm. Where electrostatic hold down of the receiver member is employed, it is more preferred to have the endless belt or web have a bulk resistivity of greater than $1\times10^{12}$ ohm-cm. This bulk resistivity is the resistivity of at least one layer if the belt is a multilayer article. The web material can be of any of a variety of flexible materials such as a fluorinated copolymer (such as polyvinylidene fluoride), polycarbonate, polyurethane, polyethylene terephthalate, polyimides (such as Kapton® supplied by DuPont High Performance Materials), polyethylene napthoate, or silicone rubber. Whichever material is used, such web material can contain an additive, such as an anti-stat (e.g. metal salts) or small conductive particles (e.g. carbon), to impart the desired bulk resistivity for the web. When materials with high bulk resistivity are used (i.e., greater than about $10^{11}$ ohm-cm), additional corona charger(s) can be needed to discharge any residual charge remaining on the receiver member transport web once the receiver member has been removed. The receiver member transport web can have an additional conducting layer beneath the resistive layer which is electrically biased to urge marking particle image transfer, however, it is more preferable to have an arrangement without the conducting layer and instead apply the transfer bias through either one or more of the support rollers or with a corona charger. The endless belt is relatively thin (20 micrometers–1,000 micrometers, preferably, 50 micrometers–200 micrometers) and is flexible. It is also envisioned that the invention applies to an electrostatographic color machine wherein a generally continuous paper web receiver is utilized and the need for a separate paper transport web is not required. Such continuous webs are usually supplied from a roll of paper that is supported to allow unwinding of the paper from the roll as the paper passes as a generally continuous sheet through the apparatus.

In feeding a receiver member onto receiver member transport web 516, charge can be provided on the receiver member by charger 526 to electrostatically attract the receiver member and "tack" it to the receiver member transport web 516. A blade 527 associated with the charger 526 can be provided to press the receiver member onto the belt and remove any air entrained between the receiver member and the belt.

A receiver member can be engaged at times in more than one image transfer nip and preferably is not in the fuser nip and an image transfer nip simultaneously. The path of the receiver member for serially receiving in transfer the various different color images is generally straight facilitating use with receiver members of different thicknesses.

The endless receiver member transport web 516 is entrained about a plurality of support members. For example, as shown in FIG. 7, the plurality of support members are rollers 513, 514 with preferably 513 being driven as shown by motor M (of course, other support members such as skis or bars would be suitable for use with this invention). Drive to the receiver member transport web can frictionally drive the intermediate transfer member rollers to rotate the intermediate transfer members, which in turn causes the sleeved primary image-forming member rollers to be rotated, or additional drives can be provided. The process speed is determined by the velocity of the receiver member transport web which can be any useful velocity, typically about 300 mm/sec.

Support structures 575*a*, 575*b*, 575*c*, 575*d*, and 575*e* are provided before entrance and after exit locations of each transfer nip to engage the belt on the backside and alter the straight line path of the belt to provide for wrap of the belt about each respective intermediate transfer member roller so that there is wrap of the belt of greater than 1 mm on each side of the nip (pre-nip and post-nip wraps) or at least one side of the nip and preferably the total wrap is less than 20 mm. The nip is where the pressure roller contacts the backside of the belt or where no pressure roller is used, where the electrical field is substantially applied. However, the image transfer region of the nip is a smaller region than the total wrap. The wrap of the belt about the intermediate transfer member roller also provides a path for the lead edge of the receiver member to follow the curvature of the intermediate transfer member but separate from engagement with the intermediate transfer member while moving along a line substantially tangential to the surface of the cylindrical intermediate transfer member. Pressure applied by the transfer backing rollers 521B, 521C, 521M, and 521Y is upon the backside of the receiver member transport web 516 and forces the surface of the compliant intermediate transfer member to conform to the contour of the receiver member during transfer. Preferably, the pressure of each transfer-backing roller 521B, 521C, 521M, and 521Y on the receiver member transport web 516 is 7 pounds per square inch or more. The transfer-backing rollers can be replaced by corona chargers, biased blades or biased brushes. Substantial pressure is provided in the transfer nip to realize the benefits of the compliant intermediate transfer member which are conformation of the toned image to the receiver member and image content on both a microscopic and macroscopic scale. The pressure can be supplied solely by the transfer biasing mechanism or additional pressure applied by another member such as a roller, shoe, blade or brush.

It is to be understood in FIG. 7 that the amount of pre-nip wrap and post-nip wrap can be set to any convenient values in any of the modules, and can be made to differ module to module by adjustments of the individual elevations of individual support structures or by placing the support structures at points that are not half-way between modules, or both. Moreover, in order to have independent control of the amounts of pre-nip and post-nip wrap within each module, a larger number of support structures can be used, e.g., two support structures per module, one on each side of each transfer nip. Support structures can include skids, bars, rollers, and the like.

Figure 8:
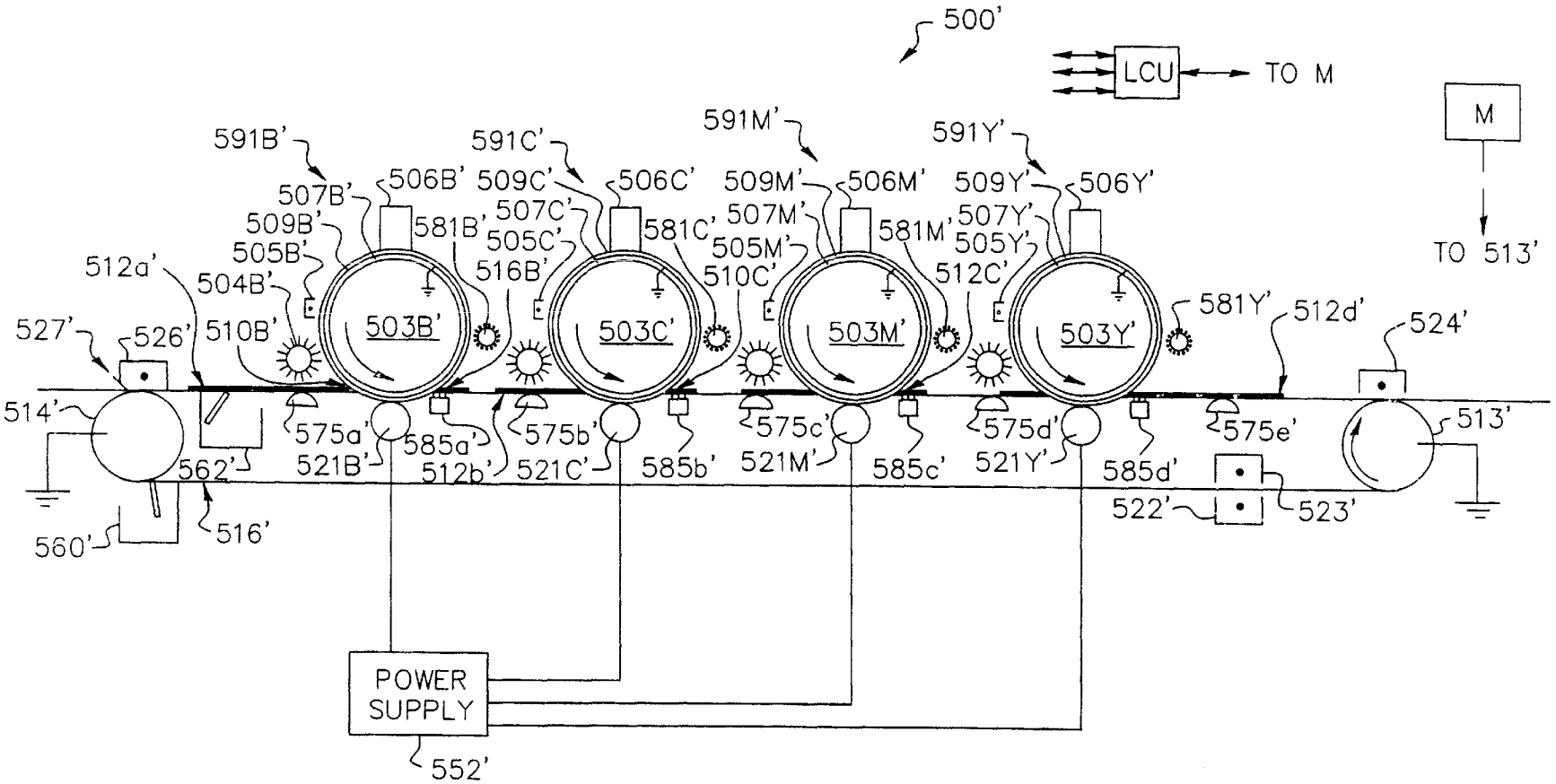
FIG. 8 is a generally schematic side elevational view of an imaging apparatus utilizing four modules, each module including a sleeved compliant photoconductive primary image-forming member roller with an endless web and web-driving mechanism for facilitating electrostatic transfer of a single-color toner image from the primary image-forming member roller to a receiver member adhered to and carried by the endless web through each of the four modules, only basic components being shown for clarity of illustration.

With reference to FIG. 8, structures shown therein that are similar to structures in FIG. 7 are identified with a prime (') after the reference numbers. In the embodiment of FIG. 8, a toner color separation image of one of each of four colors is formed by each module 591B', 591C', 591M', and 591Y' on respective sleeved primary image-forming member photoconductive drums 503B', 503C', 503M', and 503Y', each drum having a removable, replaceable, photoconductive sleeve 509B', 509C', 509M', and 509Y' and a compliant central member 507B', 507C', 507M', and 507Y'. In FIG. 8 the dimensions and electrical and physical properties of the stiffening layer, charge-generating layer and charge-transport layer of the photoconductive sleeve 509B', 509C', 509M', and 509Y' are similar to those in the preferred embodiments previously described above for the sleeve 509B, 509C, 509M, and 509Y in FIG. 7. The respective toned color separation images are transferred in registered relationship to a receiver member as the receiver member serially travels or advances from module to module receiving in transfer at each transfer nip (510B' is the only nip designated) a respective toner color separation image. In the embodiment of FIG. 8, the intermediate transfer members are not present and direct transfer of each image is made from the respective sleeved photoconductive drums to the receiver sheet as the receiver sheet serially advances through the transfer stations while supported by the receiver member transport web 516'. In the preferred embodiment for direct transfer of toner images from sleeved primary image-forming members to receiver sheets, microcompliance is provided to the photoconductive sleeve 509B' by including a thin compliant layer coated on the stiffening layer underneath the charge-generating layer and the charge-transport layer coatings, the thin compliant layer having a thickness preferably in a range 0.5–2.0 micrometers. The preferred electrical and physical properties are similar to those in the embodiment previously described above for the thin compliant layer of an embodiment of sleeve 509B in FIG. 7. A thin conductive layer, e.g., of nickel, can be coated on top of the thin compliant layer, upon which are successively coated an optional barrier layer, a charge-generating layer, and a charge-transport layer, as also described above. The thin conductive layer is preferably grounded during operation.

Figure 9:
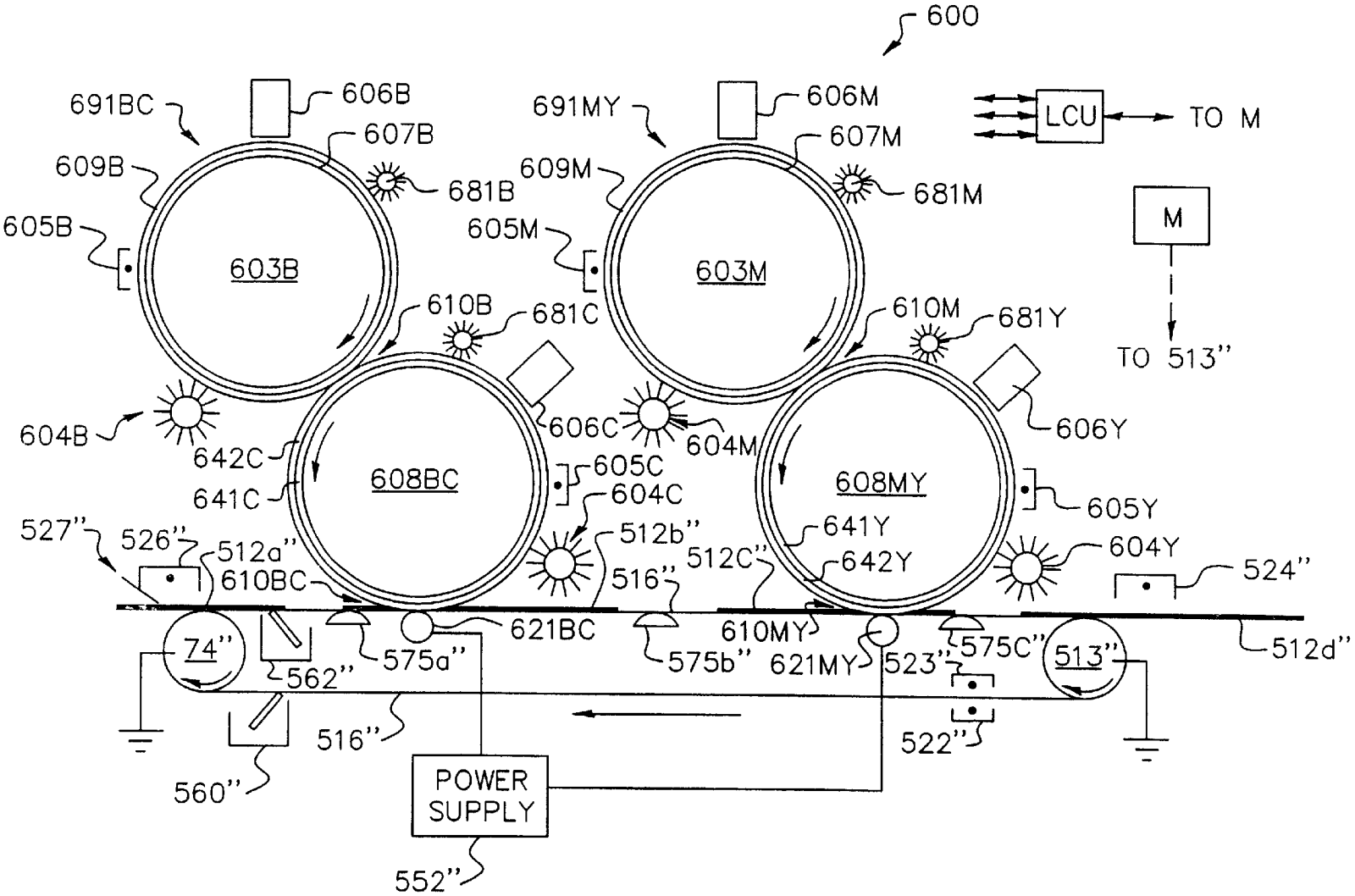
FIG. 9 is a generally schematic side elevational view of an imaging apparatus utilizing two modules, each module including a sleeved photoconductive primary image-forming member from which a first color toner image is electrostatically transferred in registry on top of a second color toner image located on a compliant bifunctional intermediate transfer roller having a photoconductive layer or layers, the second color toner image priorly created electrophotographically on the bifunctional roller, with an endless web and web-driving mechanism for facilitating electrostatic transfer of the superposed first and second color toner images from the intermediate transfer member roller to a receiver member adhered to and carried by the endless web through each of the two modules, only basic components being shown for clarity of illustration.

In another preferred embodiment, the number of modules required for full-color imaging is reduced by utilizing compliant sleeved primary image-forming members (sleeved primary image-forming members) as bifunctional photoconductive intermediate transfer members. With reference to FIG. 9, structures shown therein that are similar to structures in FIGS. 7 and 8 are identified with a double prime (") after the reference numbers. In the embodiment of FIG. 9, an apparatus designated by the numeral 600 includes two modules 691BC and 691MY, although a different number of modules can be employed. Each module is of similar construction except that as shown one receiver member transport web 516" which can be in the form of an endless belt operates with all the modules, and receiver members 512*a*", 512*b*", 512*c*", and 512*d*" are transported by the receiver member transport web 516" from module to module. Module 691 BC for example includes a rotating photoconductive sleeved primary image-forming member drum 603B engaging a counter-rotating bifunctional photoconductive intermediate transfer member drum 608BC in a pressure nip indicated by the label 610B, the drum 608BC also engaged in a pressure nip indicated as 610BC produced by transfer-backing roller 621BC behind the paper transport web 516", the receiver member transport web frictionally driving the drum 608BC. Movement of receiver member transport web 516" is indicated by an arrow. Sleeved primary image-forming member drum 603B includes a compliant central member 607B further including a rigid cylindrical core member with a compliant layer formed on it, and a removable, replaceable photoconductive sleeve imaging member 609B preferably non-adhesively gripping and surrounding the central member. Photoconductive drums 603B and 608BC have material characteristics similar to those for drums 503B, 503C, 503M, and 503Y described above. On each of the drums 603B, 608BC, 603M, and 608MY a different single-color toner image is formed, made for example from black, cyan, magenta, and yellow toners indicated by the letters B, C, N, and Y, respectively, or from different colors, or a different number of colors. Also, toners including non-color attributes can be used. In module 691BC, a black toner image is formed on photoconductive drum 603B, using charger 605B, laser 606B and development station 681B, and a cyan toner image is formed on photoconductive drum 608BC, using charger 605C, laser 606C and development station 681C. The black toner image is electrostatically transferred in the nip 610B from drum 603B to the drum 608BC such that the black toner image is transferred on top of the cyan image, thereby forming a registered first composite image. Rotary motion of drum 608BC brings the first composite image into the nip 610BC where the first composite image is electrostatically transferred to a receiver sheet, such as for example the paper sheet 512*b*". In module 691MY, a magenta toner image created on sleeved primary image-forming member 603M and a yellow toner image created on photoconductive intermediate transfer member 608MY are similarly combined in nip 610M to form a second composite image which is transferred on top of the first composite image in nip 610MY to create a registered four-color composite toner image on the receiver sheet.

Prior to forming single-color toner images on photoconductive drums 603B, 608BC, 603M, and 608MY, the outer surfaces of the respective sleeves are cleaned by the respective cleaning stations 604B, 604C, 604M, and 604Y.

In the three embodiments of FIGS. 7, 8, and 9, the transfer-backing rollers 521, 521', and 621BC have a preferred diameter of 20–80 mm, preferably running in a constant current mode. The diameters of the sleeved primary image-forming member and intermediate transfer member members are preferably in the range of 80–240 mm. Also, in the three machine embodiments of FIGS. 7, 8, and 9, different receiver sheets can be located in different nips simultaneously and at a times one receiver sheet can be located in two adjacent nips simultaneously, it being appreciated that the timing of image creation and respective transfers to the receiver sheet is such that proper transfer of images are made so that respective images are transferred in register and as expected.

Although it is preferred to be a drum, an intermediate transfer member in the form of a web can be used with a sleeved primary image-forming member in the color reproduction apparatus described herein. Similarly, a sleeved primary image-forming member in the form of a web can be used, although not preferred.

In the color reproduction apparatus described herein, the apparatus can also be used to form color images in various combinations of color in lieu of the four-color image described. Fewer color modules can be provided in the apparatus or additional color modules can be provided in the apparatus. While the description herein is directed to formation of a composite resultant image on a receiver sheet formed of plural color images, the invention contemplates that images of different physical types of toner can be combined on a receiver sheet to form a composite resultant image. Thus, a black toner image can be transferred to a receiver sheet wherein the toner image is formed of non-magnetic toner and a second black image formed on the same receiver sheet using a magnetic toner using the transfer apparatus and methods described herein.

In the described embodiments, the wrap of the belt that supports the receiver member in contact with the toner image-bearing member is defined by tension in the transport belt. The actual transfer nip where the major portion of the electrical field exists between the toner image-bearing member and the transfer-backing roller or other counter electrode for transfer of the toner image to the receiver member is smaller than this wrap. Thus, by providing a greater amount of wrap length than the length of the actual transfer nip there is reduced the likelihood of pre-nip transfer and pre-nip ionization particularly where the transport belt is substantially insulative. As noted above, it is preferred to have the wrap be greater than 1 mm beyond the roller nip in at least the pre-nip area. Where a transfer-backing pressure roller is used to apply the pressure to the underside of the belt to urge the receiver member into intimate contact with the toner image-bearing member at the nip, it is preferred that the pressure roller be of intermediate conductivity, i.e., bulk resistivity of $10^7$–$10^{11}$ ohm-cm; however, transfer-backing rollers that are highly conductive, i.e., having conductivity of a metal, also can be used. Other structures, as noted above, in lieu of transfer-backing rollers can be used to apply pressure to the web at the nip including members having conductive fibers that are electrically biased and provided with stiffener structure on either side of the brush for applying pressure to the web, or rollers with conductive fibers.

In the embodiments described above, transfer of the toner image from the sleeved primary image-forming member to the intermediate transfer member and from the intermediate transfer member to the receiver member and generally all toner image transfers are made electrostatically and preferably without addition of heat that would cause the toner to soften. Thus, preferably no fusing occurs upon transfer of the toner images to the receiver member in the nips through which the paper transport belt and receiver member passes. In the forming of plural color images in registration on a receiver sheet, the invention contemplates that plural color toner images can be formed on the same image frame of the photoconductive image member using well-known techniques (see, for example, Gundlach, in U.S. Pat. No. 4,078,929). The primary image-forming member can form images by using photoconductive elements as described or dielectric elements using electrographic recording. The toners used for development are preferably dry toners that are preferably nonmagnetic and the development stations are known as two-component development stations. Single component developers can be used, but are not preferred. While not preferred, liquid toners can also be used.

Other charging means such as rollers can be used instead of the corona wire chargers used for electrostatically holding the receiver member or print media to the web ("tacking") and also for electrically discharging the receiver member.

Cleaning of the front side and back side of the receiver member transport web can be provided by wiper blades 560*a* and 562*a* (FIG. 7); 560*a*', 562*a*' (FIG. 8); or 560*a*", 562*a*" (FIG. 9), respectively. It is preferred to use wiper blades for both of the front and backside cleaning.

Additional thin coating layers (not indicated in any of the figures) for promoting inter-layer adhesion can be employed in the fabrication of sleeve members, such as for example priming or subbing layers well known in the art can be used.

In order to promote placement or removal of a sleeve of the invention, sub-micron particles of silica, titania and the like can be applied to the outer surface of a central member, to an inner surface of a sleeve member. Alternatively, a surface region having a thickness of the order of a few molecular dimensions and chemically selected or modified to include chemical molecular groups exhibiting a low surface energy can be provided on these surfaces (not indicated in any of the figures).

The invention discloses a sleeved photoconductive primary-image-forming member roller for use in an electrostatographic machine. A sleeve member is placeable on a compliant central member by a sleeve placement method, and is removable from the central member by a sleeve removal method, the sleeve member retaining a form of an endless belt not only during operation of the sleeved primary image-forming member, but also during placement of a sleeve member or during removal of a sleeve member. In one of the preferred embodiments, the sleeved primary image-forming member can be used as a bifunctional photoconductive intermediate transfer member.

A preferred sleeve placement method includes providing a source of a pressurized fluid to the underside of a sleeve member, the preferred pressurized fluid being compressed air; turning on the source of the pressurized fluid to elastically expand the sleeve member so as to allow the sleeve member to be moved along the surface of a central member in order to surround the central member; continuing to keep open the source of pressurized fluid while sliding the sleeve member to be moved until it reaches a predetermined position surrounding the other member; shutting off the source of the pressurized fluid, thereby allowing the sleeve member to relax and grip the said another member under tension. Other methods of aiding sleeve placement can be used, including separately heating the sleeve member being placed on a central member, or separately cooling the substrate, in order to take temporary advantage of dimensional changes produced by the heating or cooling.

A preferred sleeve removal method includes providing a source of a pressurized fluid to the underside of a sleeve member, the preferred pressurized fluid being compressed air; turning on the source of the pressurized fluid to elastically expand the sleeve member so as to allow the sleeve member to be moved along the surface of a central member; continuing to keep open the source of pressurized fluid while sliding the sleeve member and removing it from the central member; shutting off the source of the pressurized fluid. Other methods of aiding sleeve removal can be used, including separately heating the sleeve member being removed from the central member, or separately cooling the substrate, in order to take temporary advantage of dimensional changes produced by the heating or cooling.

Turning now to preferred embodiments having electrostatographic and photoconductive sleeved imaging rollers of the invention, FIG. 1 shows a cross-sectional view, indicated by the numeral 10, of an electrophotographic sleeve imaging member identified by the numeral 17 which is mounted on a central member identified by the numeral 14. The central member 14 is included of a first substrate or core member 11, a compliant layer 12 formed on the core member, and an optional protective layer 13 coated on the compliant layer. Central member 14 has a smooth surface, and preferably has a run-out of less than 80 micrometers and more preferably less than 20 micrometers. The sleeve member 17 is preferably in the form of an endless seamless tubular belt, and is included of a second substrate or stiffening layer 15 and a photoconductive structure coated on the second substrate.

The preferred core member 11 is substantially rigid and is generally not solid throughout, and as shown in FIG. 1 preferably includes a hollow cylindrical metal tube or shell made for example from aluminum. Core member 11 can have interior structures which can include chambers, e.g., for compressed air and associated piping, strengthening struts, and the like, and can be provided with holes for carrying compressed air from an interior chamber through its cylindrical shell during placement or removal of the sleeve member 17. The compliant layer (compliant layer) 12 of central member 14 preferably has a thickness in a range of about 0.5–20 mm, and a Young's modulus preferably less than about 10 MPa and more preferably in a range of about 1–5 MPa. The compliant layer 12 is preferably formed of a polymeric material, e.g., an elastomer, such as a polyurethane or other materials well noted in the published literature. The compliant layer 12 has a Poisson's ratio in a range 0.2–0.5, and can include a material having one or more phases, e.g., a foam or a dispersion of one solid phase in another. Preferably, compliant layer 12 has a Poisson's ration between about 0.45 and 0.50.

The optional protective layer 13 is preferably made from any suitable material, which is flexible and hard, e.g., a synthetic material, preferably a ceramer or a sol-gel, applied to the compliant layer 12 by any suitable coating method. Alternatively, the protective layer 13 can include a thin metal band, e.g., nickel, which can be adhered to the compliant layer 12 or which can be in the form of an endless belt under tension applied to the outer surface of the compliant layer 12 by, for example, using compressed air assist, or by mounting the central member on a mandrel and cooling in order to shrink it so as to slide on the metal band. The protective layer 13 has a thickness preferably in a range 1–50 micrometers and more preferably in a range 4–15 micrometers, and a Young's modulus preferably greater than 100 MPa and more preferably in a range 0.5–20 GPa.

Figure 2A:
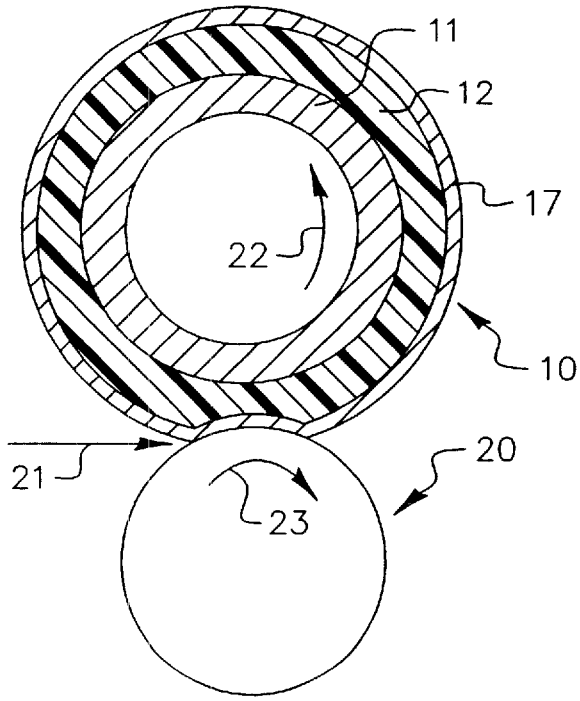
FIG. 2(*a*) is a schematic cross-sectional view, not to scale, of a photoconductive member of the invention in pressure contact with a sheet-feeding roller.
Figure 2B:
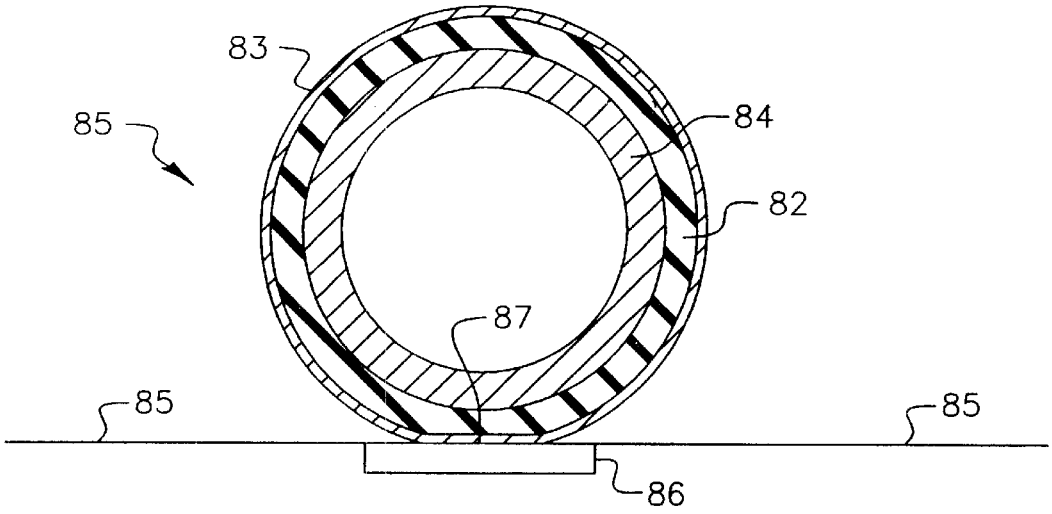

In FIG. 2(*a*) of the drawings, the photoconductive member 10 of FIG. 1 is shown in contact with a sheet-feeding roller or back-up roller 20 which exerts pressure against photoconductive member 10 and causes the compliant layer 12 of the central member to deform at the nip between roll 20 and flexible photoconductive sleeve 17 and form an enlarged area of contact 21 (layer 13 omitted). As the member 10 and the roller 20 rotate on their longitudinal axes in the directions shown by arrows 22 and 23 a sheet of paper or other toner receiving sheet material is fed into the nip for electrostatic transfer of toner to the receiving sheet. Because of the enlarged nip area formed by the compliant layer 12, the electrostatic transfer of toner to the receiving sheet is markedly improved as compared with transfer from a conventional photoconductive imaging drum.

Another way of employing the photoconductive member of the invention is shown by FIG. 2(*b*). In this embodiment, the photoconductive member 80 has a first substrate, which is a rigid hollow cylinder or core 84. On this substrate is coated the compliant layer 82 and mounted on the latter in a close-fitting but non-adhesive relationship is a sleeve 83 having a thin-walled nickel tube (not shown) on which is coated the thin photoconductive layer (not shown). FIG. 2(*b*) illustrates the transfer of toner from photoconductive member 80 to a continuous web of paper, plastic or other material 85. The web 85 is drawn across a backing member 86 against which the photoconductive member presses to cause flattening of the compliant layer 82 and consequent enlargement of the nip area 87 where electrostatic transfer of toner from photoconductive layer 84 to the moving web 85 occurs. Backing member 86 can be a roller, a skid, a bar, or the like.

Figure 3:
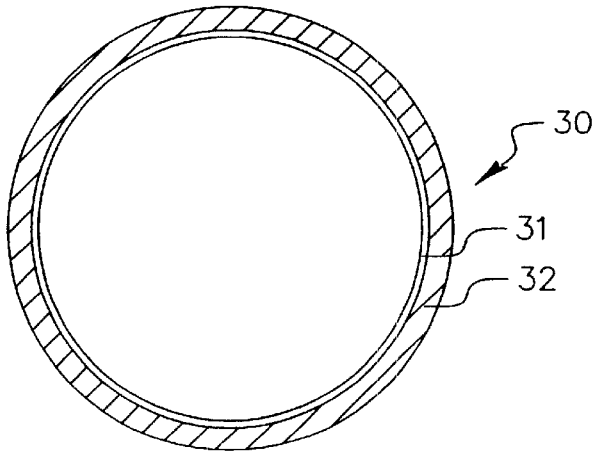
FIG. 3 illustrates a cross-sectional view of a sleeve of a primary image-forming member of the invention.

FIG. 3 illustrates a photoconductive sleeve member identified as 30, which is useful for a sleeved primary image-forming member drum. Sleeve 30 is preferably an endless tubular belt and includes a second substrate layer 31 and a photoconductive structure 32 surrounding and adhered to the second substrate layer. Sleeve 30 can also include a compliant layer (not separately indicated in FIG. 3) preferably located underneath the photoconductive structure 32. The photoconductive structure can include one or more layers which can include any known suitable photoconductive material, such as for example, an inorganic material or dispersion, a homogeneous organic photoconductive layer, an aggregated organic photoconductive layer, a composite structure having a charge-generating layer plus a charge-transport layer, and the like. The second substrate 31 is preferably conductive with a bulk or volume electrical resistivity of less than about $10^{10}$ ohm-cm, and connectable to ground potential. However, in some applications it can be desirable to use a non-conductive second substrate layer, in which case stiffening layer 31 can be coated with a thin conductive material, e.g., a metallic film, applied its surface, which is connectable to ground potential. The second substrate layer 31 includes any suitable flexible material. The second substrate layer can include a sheet formed in to an endless tube joined by a seam to create an endless belt, but a seamed second substrate is less preferred. Preferably, the second substrate has a form of an endless seamless belt. The second substrate can be a backing layer or a stiffening layer. A backing layer, which is less preferred for the second substrate, can be included of any suitable material having a Young's modulus of 100 MPa or less, such as for example a polymer, a fabric, a plastic, or any other material suitable as a support or backing for the photoconductive structure. A stiffening layer (stiffening layer) is preferred for the second substrate. The stiffening layer has a thickness less than 500 micrometers and more preferably in a range of about 10–200 micrometers. The stiffening layer in general should have a yield strength which is not exceeded during operation of the sleeved primary image-forming member, with the stiffening layer remaining as a continuous belt and which does not crack or break up into platelets. The stiffening layer also has a Young's modulus preferably greater than about 0.1 GPa and more preferably in a range of about 50—300 GPa.

FIG. 4(*a*) shows a preferred embodiment of a photoconductive sleeve as indicated by a composite structure 40A, which includes a stiffening layer 41, a barrier layer 42 coated on the stiffening layer, a charge-generating layer 43 coated on the barrier layer, and a charge-transport layer 44 coated on the charge-generating layer. Sleeve 40A is preferably an endless tubular belt. The stiffening layer 41 is preferably an endless tubular belt, and more preferably is a seamless belt. The stiffening layer can include any suitably flexible material having a thickness less than 500 micrometers and more preferably in a range of about 10–200 micrometers, and a Young's modulus greater than about 100 MPa and more preferably in a range of about 50–300 GPa. More preferably the stiffening layer 41 is an electroformed seamless nickel belt 0.005 inch (127 micrometers) thick available, e.g., from Stork Screens America, Inc. of Charlotte, N.C. The barrier layer 42 includes any suitable material, such as for example a nylon that prevents charge injection from the stiffening layer 41, and the barrier layer preferably includes a polyamide resin layer having thickness greater than about 0.5 micrometer and preferably greater than about 1.0 micrometer coated on stiffening layer 41. The charge-generating layer 43 can be included of any suitable materials, including dispersions, such as are well known in the literature. Preferably, charge-generating layer 43 is of the type described by Molaire et al., in U.S. Pat. No. 5,614,342, and includes a co-crystal dispersion coated on the barrier layer, the charge-generating layer having a thickness in a range 0.5–1.0 micrometer and preferably about 0.5 micrometer. The charge-transport layer 44, coated on the charge-generating layer 43, has thickness in a range 12–35 micrometers and is preferably about 25 micrometers thick. Charge-transport layer 44 can include any suitable compositions and materials such as are well known in the published literature, and preferably includes equal parts of tritolylamine and 1,1-bis{4-(di-4-tolylamino)phenyl}methane in a binder consisting of 20% wt/wt poly[4,4'-(2-norbornylidene)bisphenol terephthalate-co-azelate-(60/40)] and 80% wt/wt Makrolon™, a polycarbonate obtainable from General Electric Company, Schenectady, N.Y. The charge-transport layer 44 can be coated with an optional thin hard wear resistant layer (not shown).

FIG. 4(*b*) shows a more preferred embodiment of a photoconductive sleeve member of the invention, indicated by a composite multilayer structure 40B that has additional layers as compared to 40A of FIG. 4(*a*). Except for the additional layers, some layers of this more preferred embodiment directly correspond with layers 41, 42, 43, and 44 of sleeve 40A, and the layers, which correspond in properties and dimensions to these layers are identified as 41', 42', 43', and 44' in FIG. 4(*b*). Sleeve 40B includes a stiffening layer 41', a thin compliant layer 45 coated on the stiffening layer, a thin electrode layer 46 formed on layer 45, an optional barrier layer 42' coated on electrode layer 46, a charge-generating layer 43' coated on the barrier layer, and a charge-transport layer 44' coated on the charge-generating layer. Sleeve 40B is preferably an endless tubular belt. Layer 41', otherwise similar to layer 41 of FIG. 4(*a*), can have any resistivity, and the layers 42', 43', and 44' are to all extents and purposes similar to layers 42, 43, and 44 respectively, and so are not described further here. The charge-transport layer 44' can be coated with an optional thin hard wear resistant layer (not shown). The electrode layer 46 includes any thin conductive flexible material, such as for example nickel. Layer 46 is preferably connected to ground potential when the roller is utilized in a standard fashion as a primary image-forming member, as shown for example in FIGS. 7 or FIG. 8, and is connectable to a source of voltage or current when, as shown for example in FIG. 9, the roller is utilized bifunctionally as a bifunctional photoconductive intermediate transfer member. The relatively thin compliant layer 45 has a thickness in a range of about 0.5–2.0 mm, and a Young's modulus less than about 50 MPa and preferably in a range of about 1–5 MPa. Layer 45 has a Poisson's ratio in a range of about 0.2–0.5, and more preferably in a range of about 0.45–0.50. Despite a more costly and complicated structure of the roller of FIG. 4(*b*), it has an advantage over that of FIG. 4(*a*) in that microcompliance is provided by the thin compliant layer 45, which is desirable when, as for example indicated in FIGS. 8 and 9, such a roller is used for high quality toner transfer to a receiver such as paper.

In a less preferred modification of embodiment 40B, the thin compliant layer 45 has a resistivity preferably less than about $10^{10}$ ohm-cm and electrode layer 46 is omitted, requiring that the stiffening layer 41' be connectable to ground potential or to a source of voltage or current, and have a bulk resistivity similar to that of layer 41. In this modification, if stiffening layer 41' is insulative it is required to be coated with a thin flexible conductive layer connectable to ground potential or to a source of voltage or current.

Figure 6:
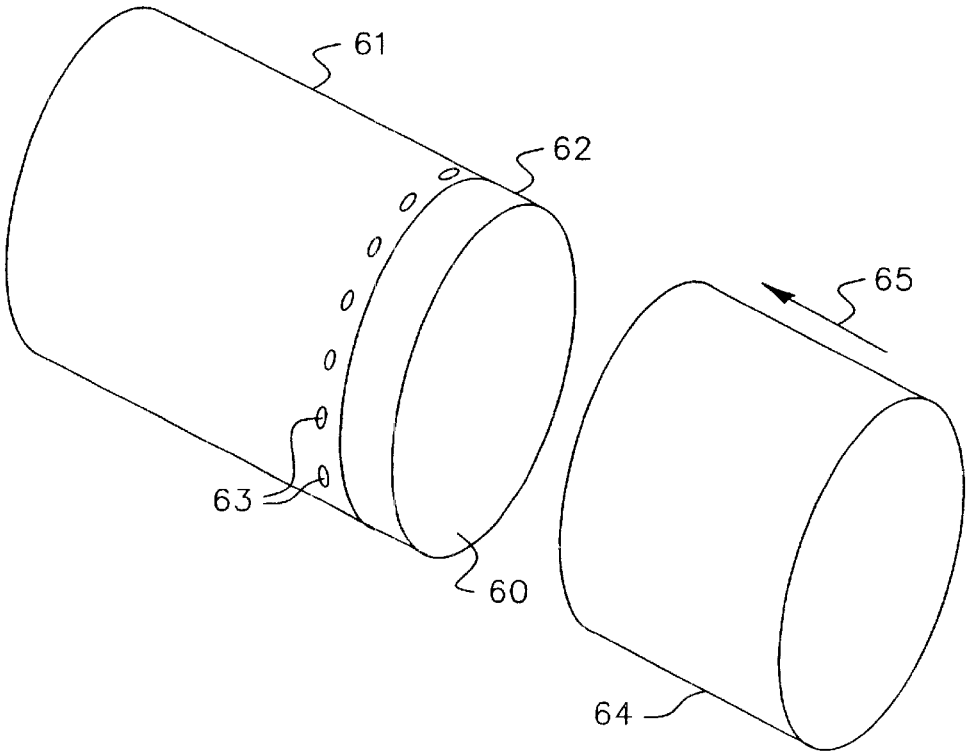
FIG. 6 is a schematic perspective view, not to scale, of the mounting of a photoconductor sleeve onto a sleeve mandrel to form an apparatus of the invention.

FIG. 6 illustrates a preferred method for assembling the photoconductive member of the invention. In this embodiment the sleeve mandrel 60 is a hollow or solid cylinder of which the surface has a layer 61 formed on it of a compliant material having a Young's Modulus less than $5\times10^7$ Pascals. The thickness of layer 61 preferably is in the range from about 0.5 to 20 mm although somewhat thicker or thinner compliant layers can be suitable. At one end of the mandrel 60 the thickness of the compliant layer in the area 62 tapers to a reduced diameter, as will be explained in more detail hereinafter.

Adjacent to the inner edge of the tapered area 62 of mandrel 61 is a line of ports 63 that extend about the entire circumference of the compliant layer. These ports communicate by means of a conduit with a source of fluid pressure, preferably, with a means for supplying compressed air to the ports.

Shown in position for sliding onto the mandrel 60 is a photoconductive sleeve 64. This can include a thin flexible tube, preferably seamless, of an electrically conductive metal such as nickel. On the surface of sleeve 64 is a photoconductive structure having one or more coated layers. To assemble the photoconductive member in a method of the invention, the photoconductor sleeve 64 is moved in the direction of arrow 65 to slide the sleeve onto the tapered area 62 of mandrel 60. The sleeve is then pushed a short distance farther until it covers the line of ports 63. At this point, because the inside circumference and diameter of sleeve 64 are equal to or slightly less than the outside circumference and diameter of the compliant layer 61, the sleeve 64 can not be pushed farther onto layer 61 without damaging the layer. At this point, in a preferred method of the invention, a fluid pressure stretching technique is preferably employed to increase temporarily the circumference of sleeve 64.

The fluid pressure technique has been disclosed for fitting a printing sleeve onto a printing roller core in U.S. Pat. Nos. 4,144,812 and 4,903,597. See also U.S. Pat. No. 5,415,961, which discloses the fabrication of an electrostatographic-imaging member by fluid pressure stretching of a bell in order to slide it onto a support drum. The disclosures of these patents are incorporated by reference herein.

Figure 5A:
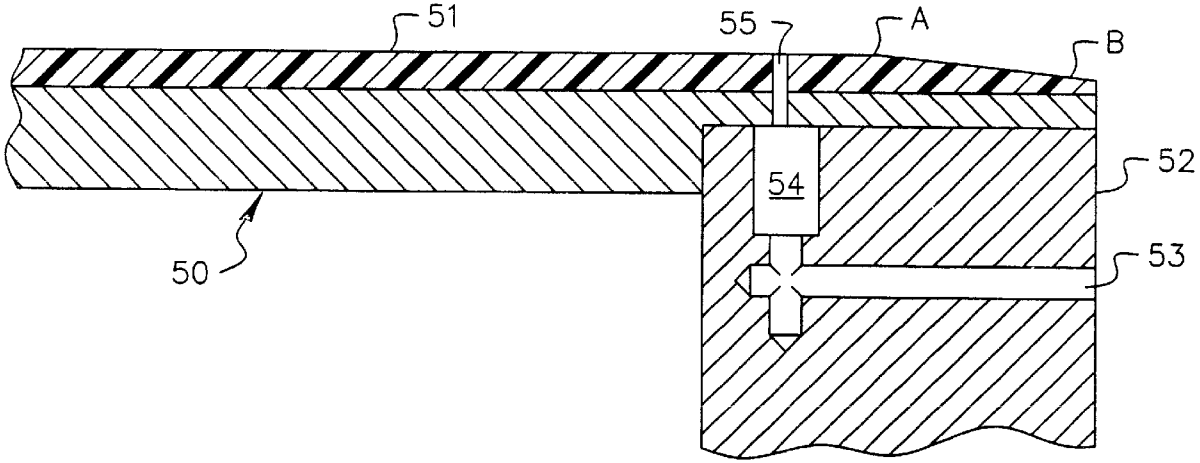
FIG. 5(*a*) is a schematic cross-section, with parts broken away and not to scale, of a preferred structure for a first substrate having a compliant outer layer.
Figure 5B:
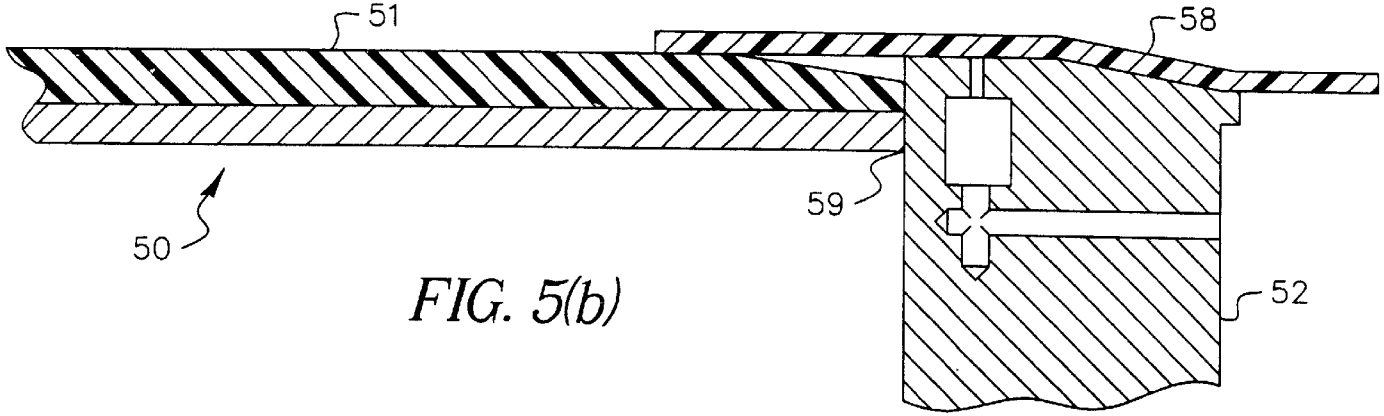

Details of a preferred structure for applying fluid pressure stretching to the photoconductor sleeve in assembling the photoconductive member of the invention are shown schematically in FIG. 5(*a*). This figure shows in cross section a portion of the end of the mandrel 60 with which the photoconductor sleeve is first contacted and around which the fluid pressure ports are positioned.

In the apparatus of FIG. 5(*a*) the mandrel or first substrate 50 has coated on its outer surface a layer 51 of compliant material of thickness from about 0.5 to 20.0 mm. Optionally, this compliant layer can have a thin coating (not shown) of a material that facilitates the sliding of the photoconductor sleeve onto the mandrel. Suitable materials for such a thin coating layer include, for example, a ceramer material as disclosed in U.S. Pat. No. 5,968,656, incorporated herein by reference.

The mandrel 50 is in the form of a cylindrical drum having an open that is closed by end-piece 52. The latter has air passages 53 and 54 that communicate with a port 55 that extends through the substrate 50 and the compliant layer 51. It will be noted that the thickness of compliant layer 51 tapers from point A to a reduced thickness at point B. Since the photoconductor sleeve which is to be slipped over mandrel has an inside diameter equal to or slightly less than the maximum outside diameter of the mandrel, this tapering of the compliant layer thickness at its end assists in beginning the sliding of the sleeve onto the mandrel.

The photoconductive sleeve is pushed onto the end of the mandrel 50 until it is just past the line of fluid ports in the mandrel, and the supply of high-pressure air to the air passages 53 and 54 begins. As the pressure rises the sleeve stretches and can then be pushed along the full length of mandrel 50. It then fully covers the mandrel and forms a photoconductive member of the invention wherein a first substrate, i.e., mandrel 50, has a layer of compliant material on its outer surface and a second substrate, having a photoconductive layer on its outer surface, is in close fitting but non-adhesive association with the compliant layer.

The end piece 52 can then be removed from the mandrel 50 and the resulting photoconductive member can be used for its intended purpose. If during its use for electrographic printing or copying, the photoconductive layer becomes worn or damaged and needs to be replaced, the end piece 52 can again be installed and the photoconductor sleeve can be removed by stretching it with elevated air pressure and sliding it off the mandrel.

FIG. 5(*b*) shows an alternative structure in which the end-piece 52 abuts the end 59 of the mandrel 50 and compliant layer 51. The photoconductive sleeve 58 is pushed over the end-piece 52 until it is in contact with compliant layer 51. Then high-pressure air is supplied to passages 53 and 54 until sleeve 58 is stretched sufficiently to slide onto the mandrel 50 and compliant layer 51.

The described fluid pressure stretching method is an advantageous method to use in making the photoconductive elements of the invention. In general, however, any method that can change the circumference of either the first substrate and its compliant layer or of the second substrate and its photoconductive layer sufficiently to permit sliding of the second substrate onto the compliant layer followed by non-adhesive engagement of these elements of the apparatus can be employed. For example, in another embodiment of the method of the invention, which is illustrated by examples hereinafter, the first substrate with the compliant blanket formed on it is chilled in order to reduce its diameter and circumference. Then the photoconductive sleeve with its second substrate is fitted at room temperature on the compliant blanket. After returning to room temperature, the compliant blanket is in firm but separable engagement with the photoconductive sleeve.

The following examples further illustrate the invention:

EXAMPLE 1

Coating of Photoconductive Member Sleeve

A 0.005 inch-thick seamless nickel belt (ID: 181.54 mm, length: 395 mm) obtained from Stork Screens America, Inc. of Charlotte, N.C., was mounted on a 181.62 mm diameter aluminum drum by the fluid-stretch method. The assembled belt was dip coated at 0.30 ips in a 3% wt/wt methanol solution of Amilan™ CM8000, a polyamide resin marketed by Bray Chemical Inc. of Japan; dried for 30 minutes at 90° C. The belt was further coated at 0.30 ips with the 75:25 titanyl phthalocyanine/titanyl fluorophthalocyanine co-crystal dispersion of Molaire et al., in U.S. Pat. No. 5,614,342, followed by drying at 90° C. for 30 minutes. Lastly, the belt was further coated, at 0.30 ips, with a charge-transport layer solution (14 wt % solids in dichloromethane as solvent) containing the following solids: 2 parts by weight of tri-tolylamine, 2 parts by weight of 1,1-bis(4-di-p-tolylaminophenyl) methane, 1 part by weight of poly[4,4'-(2-norbomylidene)bisphenol terephthalate-co-azelate(60/40, and 5 parts by weight of Makrolon™, a polycarbonate obtainable from the General Electric Company of Schenectady, N.Y., as described in U.S. Pat. No. 5,614,342. The fully coated belt was dried again at 100° C. for 30 minutes. Upon cooling, a completed photoconductive sleeve member in the form of the fully coated nickel belt was freed from the aluminum mandrel.

EXAMPLE 2

Forming of Compliant Blanket on Aluminum Mandrel

A cylindrical aluminum core was placed in the center of a cylindrical aluminum mold with a 10 mm gap between the outer core surface and the inner mold wall. The aluminum core had an outer diameter of 162.5 mm and a height of 395 mm. The cylindrical mold had the same height of 395 mm. To a one-liter plastic beaker containing 50.79 g (50.79 meq) of a trimethylolpropane based polyfunctional polyol obtained as PPG2000 from Dow Chemical Company of Midland, Mich., and two drops of a polydimethylsiloxane anti-foam agent obtained from Witco Corporation of Greenwich, Conn. as "SAG®47 Antifoam", there were added 238.09 g (164.76 meq) of a polyether based polyurethane prepolymer Andiprene® L42 obtained from Uniroyal Chemical Company of Middlebury, Conn., which analyzed as a toluene diisocyanate terminated polyether prepolymer. The reaction mixture was stirred at room temperature, under nitrogen, for two minutes, degassed under reduced pressure, (0.1 mm Hg) and poured into the gap between the aluminum core and the cylinder mold. The polyurethane polymer was cured at 80° C. for 18 hours and de-molded with the core. The roller (core plus polymer around it) was then ground to a finished outer diameter of 182 mm.

EXAMPLE 3

Assembly of Compliant Photoconductive Member

The precoated compliant blanket formed on the core was chilled, using dry ice. The precoated photoconductive belt or photoconductive sleeve of Example 1 was carefully mounted on the shrunk-chilled precoated compliant blanket of Example 2. The assembled compliant photoconductive member was heated to 45° C. in an oven for 1 hour, to eliminate condensation water. After the drying, the coated photoconductive sleeve snugly fitted the compliant blanket.

EXAMPLE 4

Electrophotographic Evaluation of Compliant Photoconductive Member

The assembled photoconductor sleeve/compliant drum of Example 3 was tested on an electrophotographic test apparatus having a process speed of 4 inches/second. The intermediate transfer drum of the apparatus had a 10 mm blanket with a resistivity of $9.7\times10^8$ ohms, and was biased to +1,000 volts. A current of 12.5 microamps was applied to the transfer backup roller during transfer to paper. A force between 3 kg and 4 kg was applied to the second nip (equivalent to a pressure between 0.48 and 0.64 pounds per linear inch). The photoconductor surface was charged to −450 volts and the toning station biased at −297 volts. A magenta developer with a toner concentration of 6.00% by weight and a charge to mass ratio between −38 and −40 microcoulombs/gm was used. Images with acceptable quality and density were made with no objectionable image artifacts. A rigid photoconductor drum was tested as a control. The imaging performances of the rigid and compliant photoconductor drums were similar. Subsequent testing at 11 inches/second also gave satisfactory results.

The photoconductor/intermediate transfer roller nip was measured for both the rigid and compliant photoconductor drums using the same engagement force as above.

Results of this test are given in Table 1, showing a larger nip width using the compliant sleeved photoconductor drum:

TABLE 1

Nip Width Comparison

| | Nip Width |
|---|---|
| Rigid photoconductor drum | 5.5 mm |
| Compliant sleeve photoconductor drum | 6.5 mm |

EXAMPLE 5

Model Calculations of Nip Widths

Theoretical results of calculations of nip widths formed by pressure contacts between three different simulated photoconductive rollers (outer diameter 182 mm) and a compliant intermediate transfer drum (outer diameter 174 mm ) were obtained using a computer to solve a finite element model.

The three simulated rollers were as follows:

(i) "photoconductive sleeve" on a rigid mandrel, the sleeve being nickel 0.005" thick with the thin photoconductive structure omitted as being mechanically not significant;

(ii) "photoconductive sleeve" on a mandrel coated with a compliant layer 10 mm thick having an assumed Young's modulus of 3.45 MPa, the sleeve being nickel 0.005" thick having Young's modulus of 200 GPa, with the thin photoconductive structure omitted as being mechanically not significant;

(iii) "compliant photoconductor" on a rigid core, having a compliant layer 10 mm thick having an assumed Young's modulus of 3.45 MPa, and with the thin photoconductive structure on the outside of the compliant layer omitted as being mechanically not significant.

Roller (i) above simulates a conventional hard photoconductive drum. Roller (ii) simulates a roller of the present invention. Roller (iii) simulates a prior art compliant roller as described in Tombs et al., in U.S. Pat. No. 5,715,505 and May et al., in U.S. Pat. No. 5,828,931.

The compliant intermediate transfer drum assumed for the calculations included a rigid core, coated by a compliant layer 10 mm thick (with no hard overcoat) having an assumed Young's modulus of 5 MPa.

The results of the calculations are shown in Table 2, in which calculated values of applied load required to obtain nip widths of 5.5 mm and 8.0 mm are tabulated for rollers (i), (ii), and (iii). The loads are measured in terms of force per unit length parallel to the roller axes.

It can be concluded from rows one and two of Table 2 that the force required to obtain a given nip width is much smaller for a roller of the invention than for a conventional rigid roller. A larger nip width is advantageous for improved transfer and image quality, and thereby the inventive roller is an improvement over the rigid roller. On the other hand, it can also be seen from rows two and three of Table 2 that a compliant photoconductive roller, similar to that described in Tombs et al., in U.S. Pat. No. 5,715,505 and May et al., in U.S. Pat. No. 5,828,931, requires considerably less force than the present inventive roller. This result is somewhat exaggerated by the simplifying assumption that the mechanical effects of the photoconductive structure could be omitted from roller (iii). However, the advantage of a greater nip width using roller (iii) as compared with roller (ii) is more than offset by the inventive roller's advantages of easier, less costly manufacture and ready replaceability of the sleeve carrying the photoconductive structure.

TABLE 2

Calculated Values of Applied Load

| Photoconductive Roller | Applied Load (Newton/mm) for a Nip Width of 5.5 mm | Applied Load (Newton/mm) for a nip Width of 8.0 mm |
|---|---|---|
| (i) | 0.9 | 1.8 |
| (ii) | 0.6 | 1.1 |
| (iii) | 0.4 | 0.7 |

The invention has been described in detail with reference to presently preferred embodiments, but it will be understood that variations and modifications can be effected within the spirit and scope of the invention.

What is claimed is:

1. A photoconductive sleeved primary image-forming member roller for use in an electrophotographic machine comprising:

a central member including a rigid cylindrical core member and a compliant layer formed on the core member; and a flexible replaceable removable photoconductive sleeve member in the form of an endless tubular belt that surrounds and nonadhesively intimately contacts the central member.

2. The roller of claim 1 wherein the compliant layer is covered by a protective layer.

3. The roller of claim 1 wherein the sleeve member further comprises:

a stiffening layer;

a barrier layer coated on the stiffening layer; and a charge-generating layer coated on the barrier layer, and a charge-transport layer coated on the charge-generating layer.

4. The roller of claim 3, further comprising:

said rigid cylindrical core member is an aluminum mandrel having an outer diameter of 162.5 mm;

said compliant layer formed on the core member being made of a polyurethane which has a finished outer diameter of 182 mm, a Young's modulus of 3.5 MPa±1.0 MPa and a Poisson's ratio of 0.49±0.01; and, said stiffening layer being in the form of a 0.005 inch thick seamless nickel belt having an inner diameter of 181.54 mm;

said barrier layer being made of a polyamide resin coated on the stiffening layer, the barrier layer having a thickness greater than 1 micrometer;

said charge-generatinglayer coated on the barrier layer comprising a 75:25 titanyl phthalocyanine/titanyl fluorophthalocyanine co-crystal dispersion having a thickness in a range 0.5–1.0 micrometer; and said a charge-transport layer coated on the charge-generatinglayer comprising 2 parts by weight of tritolylamine, 2 parts by weight of 1,1-bis(4-di-p-tolylaminophenyl) methane, 1 part by weight of poly, and 5 parts by weight of a polycarbonate, the charge-transport layer having a thickness in a range 12–35 micrometers.

5. The roller of claim 1, wherein the sleeve member further comprises:

a stiffening layer, said stiffening layer being in the form of a thick seamless nickel belt;

a barrier layer coated on the stiffening layer, said barrier layer being made of a polyamide resin coated on the stiffening layer; and a charge-generatinglayer coated on the barrier layer, and a charge transport layer coated on the charge-generatinglayer.

6. The roller of claim 5, further comprising:

a charge-transport layer coated on said charge-generatinglayer; and a thin hard wear resistant layer covering said charge-transport layer.

7. The roller of claim 1, wherein said rigid cylindrical core member is an aluminum mandrel and said compliant layer formed on said core is made of a polyurethane.

8. The roller of claim 1, wherein said sleeve member further comprises:

an indicia located on an outer surface of the sleeve member;

wherein the indicia on said an outer surface of the sleeve member are provided to indicate a parameter relative to the inner sleeve member that can be read, sensed or detected by an indicia detector, either visually, mechanically, optically, magnetically, or by means of a radio frequency.

9. The roller of claim 1, wherein the sleeve member further comprises:

a compliant layer formed on said sleeve member;

a thin electrode layer coated on the compliant layer;

a barrier layer coated on the electrode layer;

a charge-generatinglayer coated on the barrier layer; and a charge-transport layer coated on the charge-generatinglayer.

10. The roller of claim 1, wherein the sleeve member further comprises a thin, hard, wear resistant layer covering the charge-transport layer.

11. The roller of claim 1, wherein said compliant layer formed on said core has a protective layer covering the compliant layer.

* * * * *